US011112746B2

(12) United States Patent
Ushikubo

(10) Patent No.: US 11,112,746 B2
(45) Date of Patent: Sep. 7, 2021

(54) IMAGE FORMING APPARATUS AND DETACHABLE PART

(71) Applicant: Oki Data Corporation, Tokyo (JP)

(72) Inventor: Junichi Ushikubo, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 16/931,547

(22) Filed: Jul. 17, 2020

(65) Prior Publication Data

US 2021/0026289 A1 Jan. 28, 2021

(30) Foreign Application Priority Data

Jul. 22, 2019 (JP) ..... JP2019-134735

(51) Int. Cl.

*G03G 21/00* (2006.01)
*G03G 21/16* (2006.01)
*G03G 15/08* (2006.01)

(52) U.S. Cl.

CPC ..... *G03G 21/1633* (2013.01); *G03G 15/0872* (2013.01); *G03G 21/1628* (2013.01); *G03G 2221/1687* (2013.01)

(58) Field of Classification Search

CPC ..... G03G 15/0872; G03G 21/1633; G03G 21/1628; G03G 21/1676; G03G 21/1842; G03G 2215/0665; G03G 2221/1684; G03G 2221/1687; G03G 2221/1884

USPC ..... 399/111, 119, 120, 125

See application file for complete search history.

(56) References Cited

U.S. PATENT DOCUMENTS

| | | | | |
|---|---|---|---|---|
| 8,634,743 | B2 * | 1/2014 | Akaike | G03G 21/1633 399/110 |
| 9,110,404 | B2 * | 8/2015 | Nakamura | G03G 15/0886 |
| 2008/0286003 | A1 * | 11/2008 | Fukuda | G03G 21/1647 399/119 |
| 2010/0172673 | A1 | 7/2010 | Akaike | |
| 2015/0061216 | A1 | 3/2015 | Aoki et al. | |
| 2015/0338776 | A1 | 11/2015 | Sato | |

FOREIGN PATENT DOCUMENTS

| | | | | |
|---|---|---|---|---|
| JP | 59126584 | A * | 7/1984 | G03G 21/12 |
| JP | 10055102 | A * | 2/1998 | |
| JP | H10171324 | A | 6/1998 | |
| JP | 2002-072600 | A | 3/2002 | |
| JP | 2002248834 | A * | 9/2002 | |
| JP | 2006039194 | A | 2/2006 | |
| JP | 2014219627 | A * | 11/2014 | |

* cited by examiner

*Primary Examiner* — Robert B Beatty
(74) *Attorney, Agent, or Firm* — Rabin & Berdo, P.C.

(57) ABSTRACT

An image forming apparatus includes: a main body to which a detachable part is attachable, the main body having an opening; a cover that opens and closes the opening of the main body; and an insertion member that, when the detachable part is not attached to the main body, is in an inserted position where the insertion member is inserted between the main body and the cover and prevents closing of the cover, and when the detachable part is attached to the main body, is in a retreat position where the insertion member is not inserted between the main body and the cover and allows closing of the cover.

18 Claims, 16 Drawing Sheets

IMAGE FORMING APPARATUS AND DETACHABLE PART

BACKGROUND OF THE INVENTION

1. Field of the Invention

The present invention relates to an image forming apparatus and a detachable part, and is preferably applied to, for example, an electrophotographic image forming apparatus (or printer).

2. Description of the Related Art

Conventionally, there has been used an image forming apparatus that performs image formation (or printing) by forming a toner image with toner by means of an image forming portion and transferring it onto paper while conveying the paper along a conveying path formed in a housing, and applying heat and pressure to the paper by means of a fixing unit to fix the toner image.

The image forming apparatus needs to be supplied with toner, which is consumed each time an image is formed, as needed. However, since the toner is powder, if the toner is handled as it is, the toner may adhere to and contaminate the hands or surroundings of the operator. Thus, the image forming apparatus is often configured so that a toner cartridge that is a container containing toner is attachable to and detachable from a main body, and toner can be easily supplied by replacing the toner cartridge. The toner cartridge is a detachable part.

Also, such an image forming apparatus is often configured so that the main body is provided with an openable and closable cover, the toner cartridge is allowed to be attached and detached in a state in which the cover is open, and the image forming apparatus operates in a state in which the cover is closed, for the purposes of protection of the interior of the apparatus, noise control, or the like.

The image forming apparatus is provided therein with a toner receiving port for receiving toner from the toner cartridge, a toner conveying path for conveying the toner, an agitating member for agitating the toner in the toner conveying path, and the like. Thus, if the image forming apparatus starts to operate with the toner cartridge unattached, since the agitating member or the like is caused to operate with the toner receiving port open, toner may be discharged to the interior of the apparatus and contaminate it.

Thus, there has been proposed an image forming apparatus in which a cover is provided with a switch and a toner cartridge is provided with a projection (see, e.g., Japanese Patent Application Publication No. 2002-72600). Only when the toner cartridge is attached and the cover is closed, the switch is turned on and the image forming apparatus starts to operate. This prevents the image forming apparatus from erroneously starting to operate when the toner cartridge is not attached and when the cover is not closed.

However, in such an image forming apparatus, if a user closes the cover without attaching the toner cartridge and turns on the image forming apparatus, since the switch is not turned on, the image forming apparatus does not start to operate. In this case, the image forming apparatus displays, on a predetermined display, the information that the toner cartridge is not attached, the information that the cover is not closed, or the like, or emits a predetermined warning sound, thereby informing the user, for example.

In such a case, the user needs to perform turning off, opening the cover, attaching the toner cartridge, closing the cover again, and turning on, which is a complicated operation.

SUMMARY OF THE INVENTION

An object of an aspect of the present invention is to provide an image forming apparatus capable of easily preventing an erroneous operation in attachment and detachment of a detachable part with a simple configuration, and a detachable part capable of easily preventing an erroneous operation in attachment and detachment to and from a main body with a simple configuration.

According to an aspect of the present invention, there is provided an image forming apparatus including: a main body to which a detachable part is attachable, the main body having an opening; a cover that opens and closes the opening of the main body; and an insertion member that, when the detachable part is not attached to the main body, is in an inserted position where the insertion member is inserted between the main body and the cover and prevents closing of the cover, and when the detachable part is attached to the main body, is in a retreat position where the insertion member is not inserted between the main body and the cover and allows closing of the cover.

According to another aspect of the present invention, there is provided a detachable part that is attachable to and detachable from a main body when a cover for opening and closing an opening formed in the main body is open, the detachable part comprising: a link portion to be linked to an insertion member provided in the main body, wherein when the detachable part is not attached to the main body, the insertion member is in an inserted position where the insertion member is inserted between the main body and the cover and prevents closing of the cover, and when the detachable part is attached to the main body, the insertion member is in a retreat position where the insertion member is not inserted between the main body and the cover and allows closing of the cover, and wherein when the detachable part is attached to the main body, the link portion is linked to the insertion member to move the insertion member from the inserted position to the retreat position.

DETAILED DESCRIPTION OF THE INVENTION

Hereinafter, embodiments will be described with reference to the drawings.

1. Configuration of Image Forming Apparatus

Figure 1:
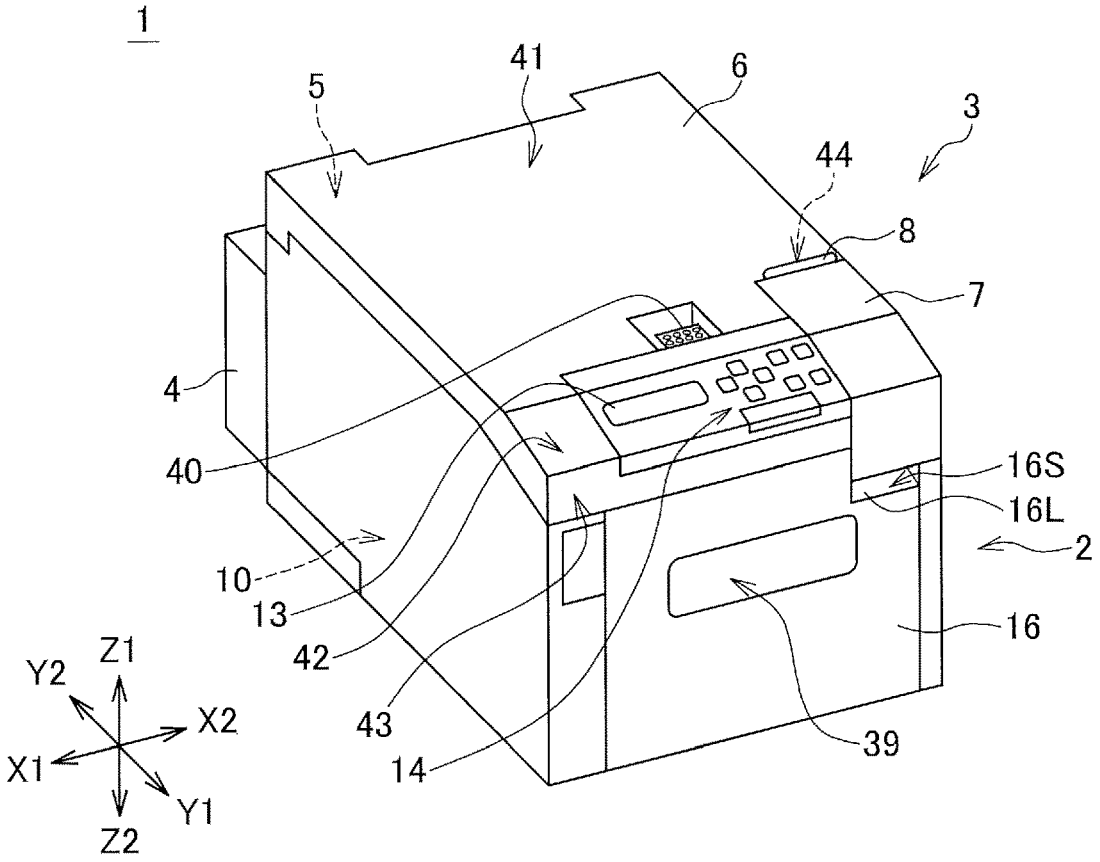
FIG. 1 is a schematic perspective view illustrating an external appearance of an image forming apparatus.

FIG. 1 is a schematic perspective view of an image forming apparatus 1. As illustrated in FIG. 1, the image forming apparatus 1 is shaped like a rectangular parallelepiped as a whole, includes various components disposed therein, and functions as a color electrophotographic printer that prints a desired color image on predetermined paper P. The following description will be made on the assumption that a surface of the image forming apparatus 1 located on the right lower side in FIG. 1 is defined as a front surface of the image forming apparatus 1, and an up-down direction, a left-right direction, and a front-rear direction are defined from the point of view of an observer facing the front surface. In the drawings, the leftward, rightward, forward, rearward, upward, and downward directions are indicated by arrows X1, X2, Y1, Y2, Z1, and Z2, respectively.

The image forming apparatus 1 is roughly constituted by a main body 2, a cover 3, and a feeder unit 4. The main body 2 occupies the lower approximately four-fifths of the front approximately two-thirds to three-fourths of the image forming apparatus 1, and includes various components installed therein. The cover 3 is located to cover the upper side of the main body 2. The feeder unit 4 is attached to the rear side of the main body 2, and conveys paper P forward to feed it to the main body 2, which will be detailed later.

Figure 2:
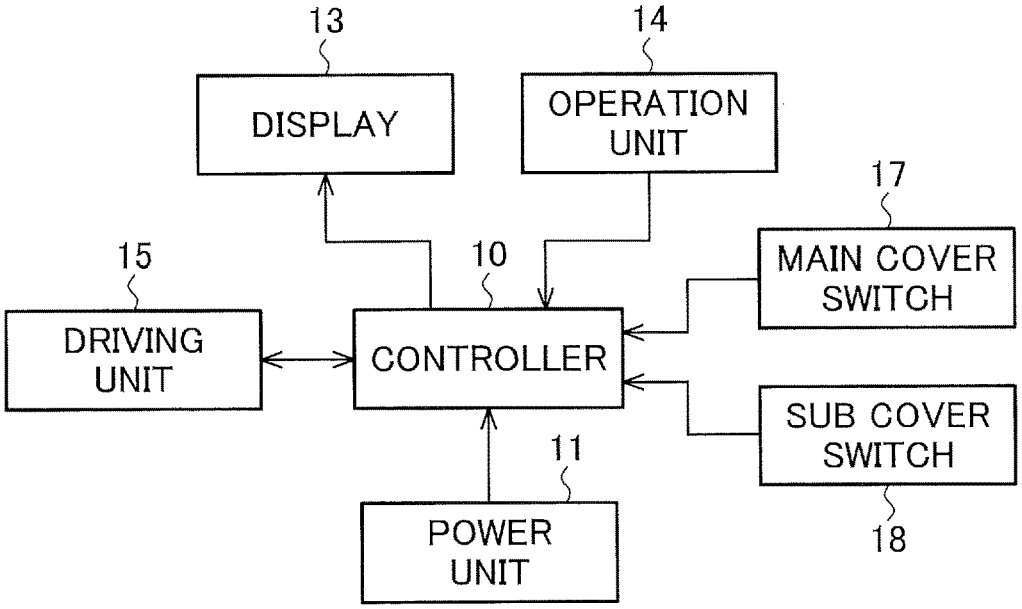
FIG. 2 is a block diagram illustrating a circuit configuration of the image forming apparatus.

A controller 10 that controls the entire image forming apparatus 1 is disposed in the lower side of the main body 2. The controller 10 includes a central processing unit (CPU), a read only memory (ROM), a random access memory (RAM), or the like, which are not illustrated, and performs various processing, such as arithmetic processing or control processing. FIG. 2 illustrates a schematic circuit configuration of the controller 10. As illustrated in FIG. 2, the controller 10 is connected to a power unit 11, a display 13, an operation unit 14, a driving unit 15, or the like. The power unit 11 is connected to a commercial power source (not illustrated), and supplies power to the controller 10 and other components after performing conversion to a predetermined direct current and other processing.

The display 13 and operation unit 14 are both disposed near a front end of an upper surface of the cover 3, as illustrated in FIG. 1. The display 13 is, for example, a liquid crystal panel, and displays various information by using characters, symbols, images, or the like under control of the controller 10. The operation unit 14 includes physical operation buttons, such as directional buttons for specifying up, down, left, and right directions, and upon receiving a pressing operation, notifies the controller 10 thereof.

The driving unit 15 includes motors, actuators, or the like, and supplies predetermined driving forces to respective parts under control of the controller 10. The controller 10 is connected to a host device (not illustrated), such as a computer, and upon receiving image data and a print command from the host device, starts a process of printing the image data.

Figure 3:
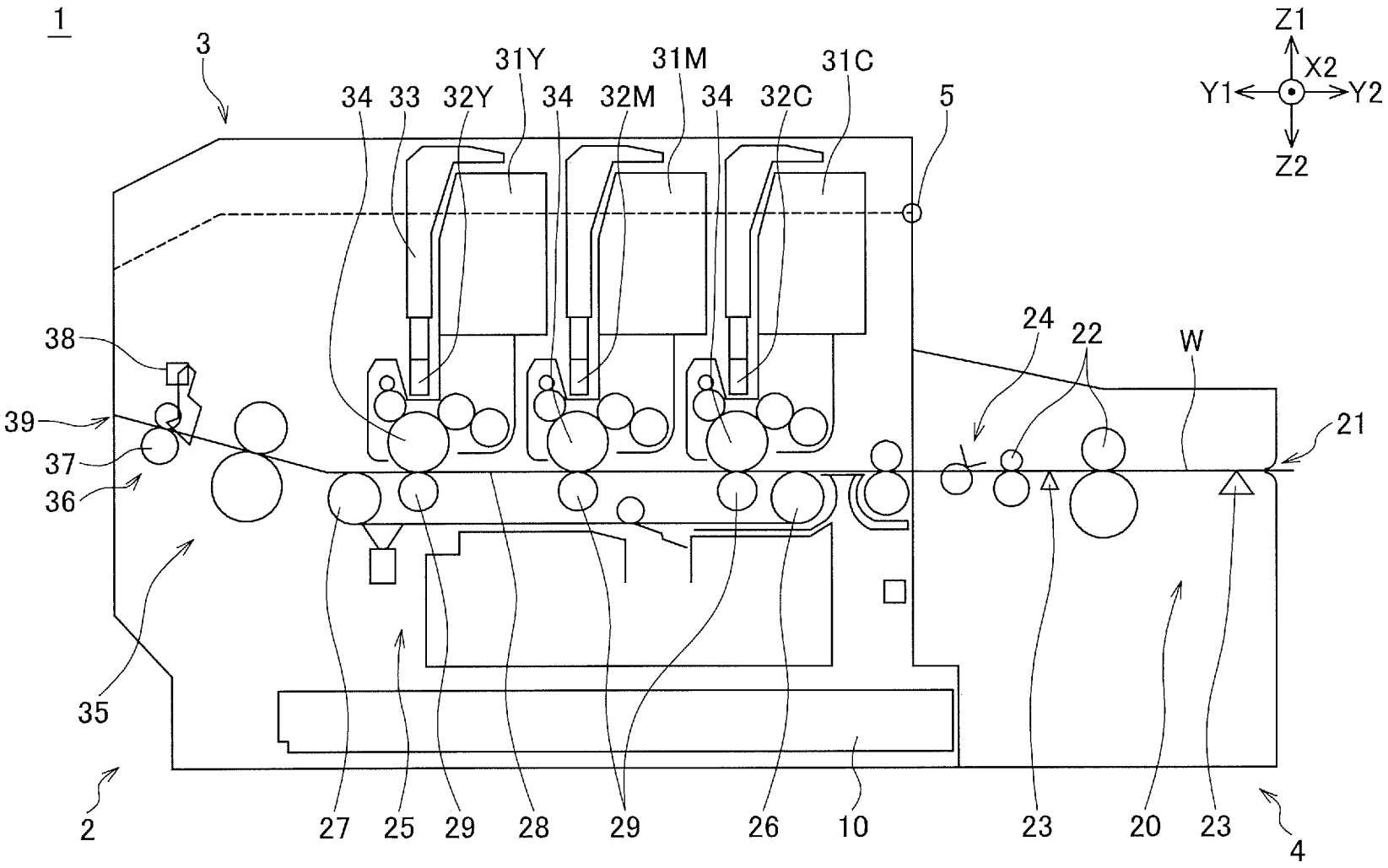
FIG. 3 is a schematic view illustrating an internal configuration of the image forming apparatus.

As illustrated in FIG. 3, in the image forming apparatus 1, a conveying path W for conveying the paper P is formed generally along the front-rear direction to pass through the feeder unit 4 and main body 2. Multiple components are disposed along the conveying path W.

The feeder unit 4 includes a paper feeding unit 20. The paper feeding unit 20 includes a paper inlet 21 disposed at a rear end of the conveying path W, and also includes pairs of conveying rollers 22 that convey the paper P forward, a sensor 23 that detects the paper P, a cutter 24 that cuts the paper P, and the like, which are disposed along the conveying path W.

The feeder unit 4 is fed with the paper P through the paper inlet 21. The paper P is in the form of a long sheet of paper and is sufficiently long in a direction (referred to below as the conveying direction) that is perpendicular to the left-right direction and along the conveying path W. For example, the paper P is in the form of a roll of paper wound around a winding shaft, and is supported rotatably about the winding shaft by a paper roll holder (not illustrated) behind the feeder unit 4.

The pairs of conveying rollers 22 are each constituted by a driving roller disposed below the conveying path W and a driven roller disposed above the conveying path W. When supplied with a driving force from a motor of the driving unit 15 (see FIG. 2), the driving roller rotates counterclockwise in the drawing. The driven roller is urged against the driving roller, and rotates clockwise in the drawing in accordance with rotation of the driving roller. With this configuration, when the paper P is conveyed to the pairs of conveying rollers 22 along the conveying path W, the pairs of conveying rollers 22 nip the paper P from above and below and convey the paper P forward. The sensor 23 detects the presence or absence of the paper P, and notifies the controller 10 of the result of the detection.

When fed with the paper P through the paper inlet 21, the feeder unit 4 conveys the paper P forward with the pairs of conveying rollers 22, detects it with the sensor 23, and cuts it with the cutter 24 into sheets of a predetermined length, under control of the controller 10. Thereby, the cut sheets of the paper P are sequentially fed to the main body 2.

In the main body 2, in front of the feeder unit 4, a conveyor 25 is disposed below the conveying path W, and three developing drum units 31C, 31M, and 31Y (which may be referred to as developing drum units 31) are arranged along the front-rear direction above the conveying path W. Light emitting diode (LED) heads 32C, 32M, and 32Y (which may be referred to as LED heads 32) are disposed in front of the developing drum units 31C, 31M, and 31Y, respectively. Each LED head 32 is attached to a lower surface of the cover 3 via a holder 33.

The conveyor 25 includes a rear belt roller 26, a front belt roller 27, a transfer belt 28 stretched around the belt rollers 27 and 28, and three transfer rollers 29 disposed between the belt rollers 26 and 27. The transfer belt 28 is an endless belt having a sufficient length in the left-right direction, and a part of the transfer belt 28 stretched on the upper side forms a lower part of the conveying path W. The three transfer rollers 29 are located beneath respective photosensitive drums 34 (to be detailed later) of the three developing drum units 31, and abut, at or near their upper ends, against a lower surface of an upper part of the transfer belt 28.

In the conveyor 25, the front belt roller 27 is supplied with a driving force from a motor of the driving unit 15 (see FIG. 2) and rotated counterclockwise in the drawing, thereby causing the transfer belt 28 to move forward in the conveying path W. At this time, when the paper P is fed from the feeder unit 4 to the conveyor 25, the conveyor 25 can nip the paper P between the transfer belt 28 supported by the transfer rollers 29 and the three developing drum units 31 and convey the paper P forward. The developing drum units 31C, 31M, and 31Y respectively correspond to colors of cyan (C), magenta (M), and yellow (Y), and have substantially the same configuration. Also, the LED heads 32C, 32M, and 32Y respectively correspond to the colors of cyan (C), magenta (M), and yellow (Y).

Each developing drum unit 31, serving as an image forming portion, includes various cylindrical rollers having central axes extending along the left-right direction, the photosensitive drum 34, and the like. The photosensitive drum 34 is cylindrical, has a central axis extending along the left-right direction, and has an outer periphery on which photosensitive material is applied. Each of the rollers and photosensitive drum 34 rotates clockwise or counterclockwise in the drawing about its central axis. Each of a subset of the rollers of the developing drum units 31 and the transfer rollers 29 has an outer peripheral portion made of conductive material, and is applied with a predetermined high voltage to be charged. The developing drum units 31 are supplied with toner from a toner cartridge 65 to be described later.

Each LED head 32 includes multiple LEDs arranged along the left-right direction (also referred to below as the main scanning direction), and the light emitting state of each LED is individually controlled by the controller 10. Each LED head 32 is located directly above the corresponding photosensitive drum 34, so that each LED can illuminate a peripheral surface of the photosensitive drum 34.

When performing a printing process, the controller 10 divides the image data into image data sets for the respective colors of cyan (C), magenta (M), and yellow (Y), and for each color, divides the image data set into image data sets for respective lines and sequentially supplies them to the LED head 32. Each LED head 32 emits light in a light emitting pattern based on the image data. In each developing drum unit 31, the peripheral surface of the photosensitive drum 34 is previously charged and illuminated by light emitted from the LED head 32 to form an electrostatic latent image, to which toner is applied to form a toner image. The toner may be referred to as developer, the photosensitive drums 34 may be referred to as image carriers, and the toner images may be referred to as developer images.

The toner images of cyan (C), magenta (M), and yellow (Y) respectively formed by the developing drum units 31C, 31M, and 31Y are sequentially transferred onto a surface of the paper P conveyed on the conveying path W. The paper P is conveyed forward along the conveying path W to a fixing unit 35.

The fixing unit 35 includes a heating roller disposed above the conveying path W and a pressure roller disposed below the conveying path W. The heating roller has a cylindrical shape having a central axis extending along the left-right direction, and when supplied with a driving force from a motor of the driving unit 15 (see FIG. 2), rotates clockwise in the drawing about the central axis. The heating roller has a heater therein, and the heater is heated by electric power supplied form the power unit 11 (see FIG. 2). The pressure roller has a cylindrical shape having a central axis along the left-right direction, and is urged upward against the heating roller.

When the paper P is conveyed to the fixing unit 35 from behind, the heating roller and pressure roller are rotated to convey the paper P forward while nipping the paper P therebetween and fixing the toner image to the paper P by applying heat and pressure.

A discharging unit 36 is disposed in front of the fixing unit 35. The discharging unit 36 includes a pair of conveying rollers 37 that conveys the paper P forward, a discharge sensor 38 that detects the paper P based on rotation or movement of a lever, and the like. The discharging unit 36 further conveys forward the paper P conveyed from the fixing unit 35 with the pair of conveying rollers 37, and discharges it forward through an outlet 39 (see FIG. 1) provided in a front panel 16 that forms the front surface of the main body 2.

2. Configuration of Cover and Opening/Closing Thereof

Figure 4:
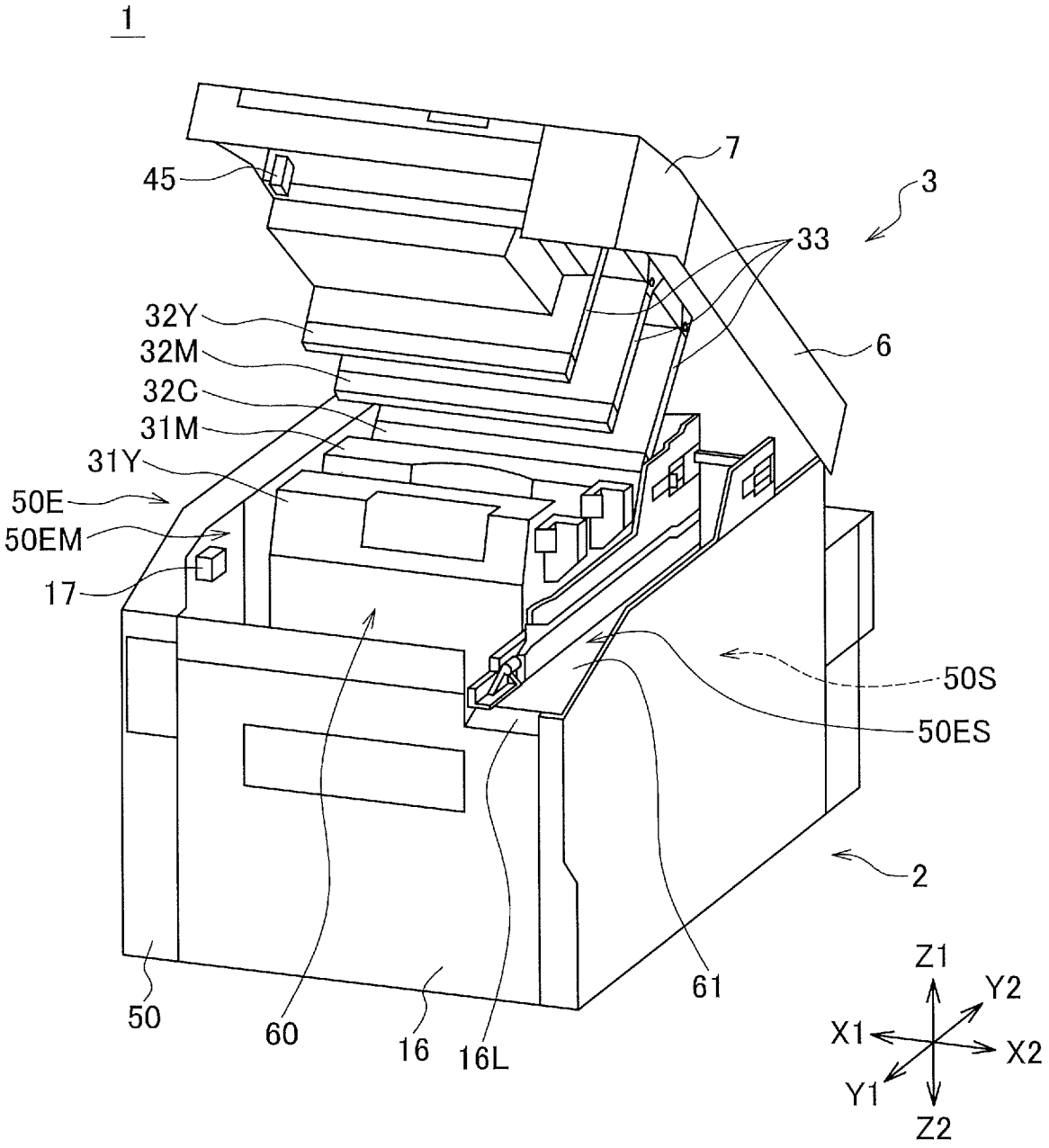
FIG. 4 is a schematic perspective view illustrating a state in which a cover of the image forming apparatus is open.

Next, a configuration of the cover 3 and opening/closing of the cover 3 relative to the main body 2 will be described. As illustrated in FIG. 1, the cover 3 is formed, as a whole, in a flat rectangular parallelepiped shape or plate shape that is thin in the up-down direction. The cover 3 is mounted to the main body 2 via a rotation portion 5 that is disposed on the lower side of a rear end of the cover 3. The rotation portion 5 allows the entire cover 3 to rotate relative to the main body 2 about a rotation axis extending along the left-right direction. In FIG. 1, the cover 3 is in a closed state in which it is placed on the upper side of the main body 2. The rotation portion 5 allows the cover 3 to rotate about the rotation portion 5 in such a manner that the front side of the cover 3 moves upward, and change from the closed state to a state in which a front end of the cover 3 is greatly separated from the main body 2, as illustrated in FIG. 4.

The front, rear, left, right, and lower sides of the main body 2 are generally closed by a housing 50. However, the upper side of the main body 2 is open except for an outer peripheral portion of the main body 2, so that the main body 2 forms a relatively large opening 50E. Also, an internal space 50S, which is relatively large, is formed in the housing 50. Various units (to be detailed later) are detachably installed in the internal space 50S. The various units are obtained by appropriately integrating various parts described with reference to FIG. 3 in view of ease of maintenance operation or the like.

When the cover 3 is placed on the upper side of the main body 2 as illustrated in FIG. 1, it closes the opening 50E of the housing 50 and covers the internal space 50S from the outside. Hereinafter, this state will also be referred to as a closed state. Also, as illustrated in FIG. 4, when the front side of the cover 3 is separated from the main body 2, it opens the opening 50E of the housing 50 and makes the internal space 50S communicate with the outside. Hereinafter, the state other than the closed state, i.e., the state in which the cover 3 is rotated from the closed state and the opening 50E is open even slightly, will also be referred to as an open state. From the closed state, the cover 3 can rotate up to about 90 degrees, i.e., until the cover 3 reaches a position where the upper surface of the cover 3 is substantially vertical.

In the closed state, the cover 3 is locked by a lock mechanism (not illustrated) installed in the cover 3 to maintain the closed state. When a release lever 40 disposed behind the display 13, operation unit 14, and the like is operated, the lock by the lock mechanism is released, allowing the cover 3 to change to the open state due to the action of a spring (not illustrated) or the like.

The cover 3 (see FIG. 1) is constituted by a main cover 6 that occupies the part of the cover 3 except its right front part, and a sub cover 7 that occupies the right front part. The main cover 6 has an upper surface 41, an inclined surface 42, a front surface 43, and the like. The rotation portion 5 is mounted to the lower side of the rear end of the cover 3, as described above. The upper surface 41 occupies the rear approximately four-fifths of the upper side of the cover 3, and forms a substantially horizontal flat surface. The inclined surface 42 is connected to a front end of the upper surface 41 and is a flat surface inclined to be lowered forward. The inclined surface 42 is provided with the display 13, operation unit 14, and the like. The front surface 43 is connected to a front end of the inclined surface 42 and is a substantially vertical flat surface.

As described above, the LED heads 32 (32C, 32M, and 32Y) are mounted to a lower surface of the main cover 6 via the three holders 33. Each holder 33 is mounted to the main cover 6 via a predetermined rotation mechanism. The rotation mechanism allows the holder 33 to rotate relative to the main cover 6 about a rotation axis extending along the left-right direction.

Thus, each holder 33 appropriately rotates relative to the main cover 6 in conjunction with rotation of the main cover 6 about the rotation portion 5. This allows the LED heads 32 to approach and separate from the developing drum units 31 while avoiding interference with the developing drum units 31. The rotation portion 5, which is a rotation center in opening and closing of the main cover 6, may be referred to as a main opening/closing portion.

A main cover switch 17 is provided on a left inner surface of the main body 2. The main cover switch 17 is a switch that changes between "on" and "off" states, and is electrically connected to the controller 10 as illustrated in FIG. 2. On the other hand, a main cover lever 45 projecting downward relative to the surrounding surface is provided on a left front part of the lower surface of the main cover 6.

When the main cover 6 is in a closed state, the main cover switch 17 is pressed down by the main cover lever 45 and is in the "on" state. When the main cover 6 rotates even slightly into an open state, the main cover switch 17 separates from the main cover lever 45 and becomes the "off" state due to the action of a spring (not illustrated) or the like. Thereby, the controller 10 (see FIG. 2) can recognize, when the main cover switch 17 is in the "on" state, that the main cover 6 is in the closed state, and when the main cover switch 17 is in the "off" state, that the main cover 6 is in the open state.

The sub cover 7 (see FIG. 1) is located in a right front part of the cover 3, and forms part of upper, front, and right surfaces of the image forming apparatus 1. The sub cover 7 is mounted to the main cover 6 via a sub cover rotation portion 8 near a rear end of an upper surface of the sub cover 7. The sub cover rotation portion 8 has a configuration similar to that of the rotation portion 5, and allows the sub cover 7 to rotate relative to the main cover 6 about a rotation axis extending along the left-right direction.

Figure 5:
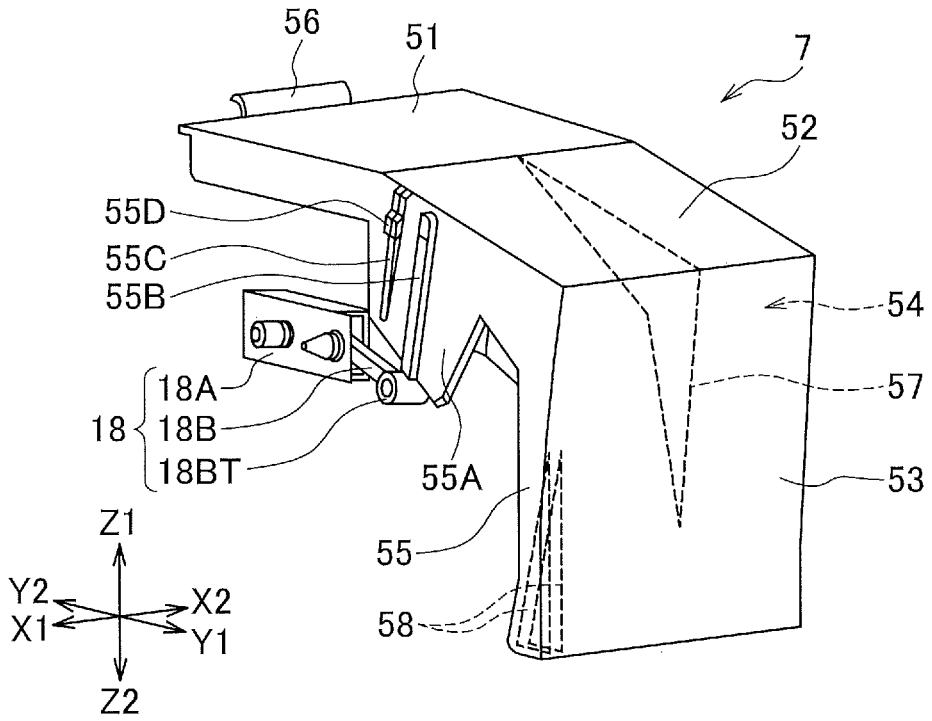
FIG. 5 is a schematic perspective view illustrating a configuration of a sub cover.

As illustrated in FIG. 5, the sub cover 7 has a shape obtained by connecting multiple plate-shaped members together, and is roughly constituted by an upper portion 51, an inclined portion 52, a front portion 53, a right portion 54, a left portion 55, and a rotation shaft bearing portion 56. FIG. 5 is a perspective view of the sub cover 7 as viewed from the upper left. In FIG. 5, the attitude (or angle) of the sub cover 7 is the same as that when the sub cover 7 is in a closed state. The sub cover 7 is a molded part obtained by molding a predetermined resin material. While the sub cover 7 has a certain degree of stiffness, it can elastically deform a little when subjected to a relatively large force.

The upper portion 51 forms a part of an upper part of the sub cover 7 from the rear side to near a center of the sub cover 7, and has an upper surface that is planar and substantially horizontal. In the closed state, the upper surface of the upper portion 51 forms a continuous uniform flat surface (or horizontal surface) together with the upper surface 41 of the main cover 6. The inclined portion 52 is connected to a front end of the upper portion 51 and forms an inclined surface that extends downward as it extends forward. In the closed state, the surface of the inclined portion 52 forms a continuous uniform inclined surface together with the inclined surface 42 of the main cover 6.

The front portion 53 is connected to a front end of the inclined portion 52 and forms a substantially vertical, flat surface facing forward. In the closed state, the surface of the front portion 53 forms a continuous uniform flat surface (or vertical surface) together with the front surface 43 of the main cover 6. As illustrated in FIG. 4, the right portion 54 has a planar surface, and is shaped like a distorted quadrangle that is longer in the front-rear direction than in the up-down direction as viewed from the left and has a rear side and a front side longer than the rear side.

The left portion 55 (see FIG. 5) has a left surface that is planar. Basically, the left portion 55 has a shape that is generally bilaterally symmetrical with that of the right portion 54 (see FIG. 4). However, the left portion 55 has a large cutout in its lower part, leaving a part near its upper edge and a part near its front edge. The left portion 55 has a left projecting portion 55A that is located generally to the left of the inclined portion 52 and projects downward from near the upper edge.

Further, the left portion 55 has two ridge portions 55B and 55C that are raised leftward relative to the surrounding surface and extend from near the connection between the left portion 55 and the inclined portion 52 to near a lower end of the left projecting portion 55A. The ridge portion 55B is formed generally in a linear shape extending along the up-down direction. As with the ridge portion 55B, the ridge portion 55C is formed generally in a linear shape extending along the up-down direction. The ridge portion 55C is provided with a sub projection 55D that further projects leftward from the ridge portion 55C, slightly below an upper end of the ridge portion 55C.

The rotation shaft bearing portion 56 forms a part of a cylindrical shape surrounding a virtual cylinder extending along the left-right direction, and forms the sub cover rotation portion 8 by being combined with a rotation shaft portion 44 (see FIG. 1) provided in the main cover 6 near a right front end of the upper surface 41. The rotation axis of the sub cover rotation portion 8 is substantially parallel to the rotation axis of the rotation portion 5.

Figure 6:
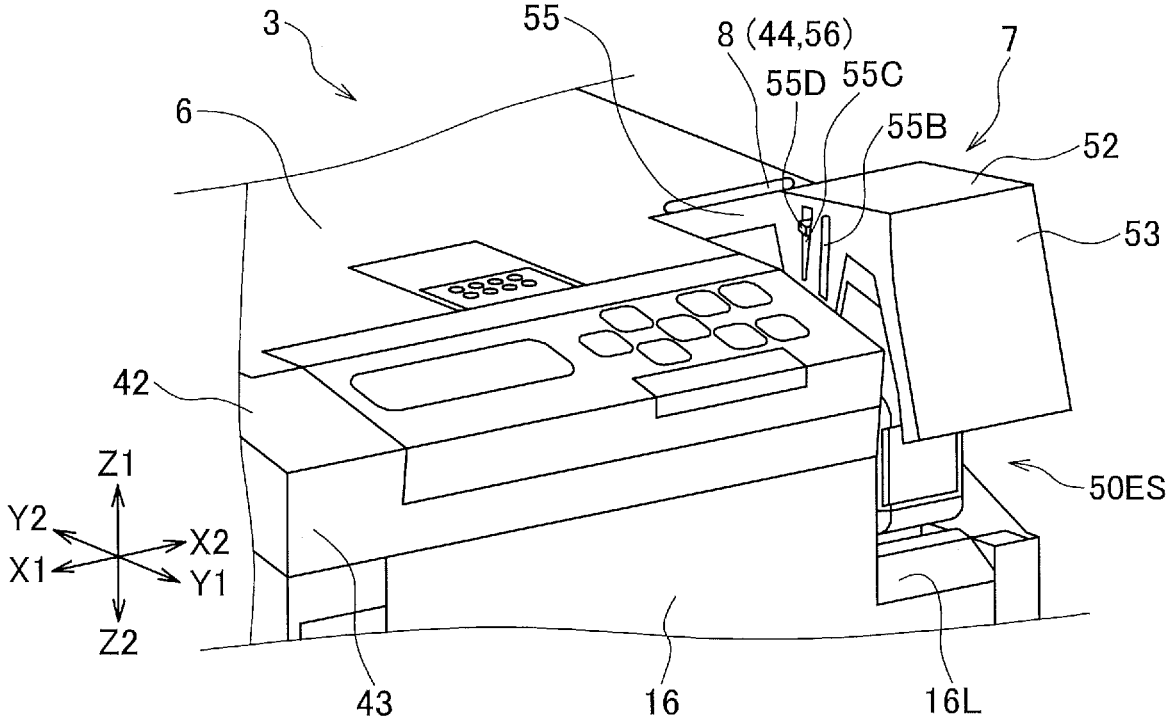
FIG. 6 is a schematic perspective view illustrating a state in which the sub cover is open.
Figure 7:
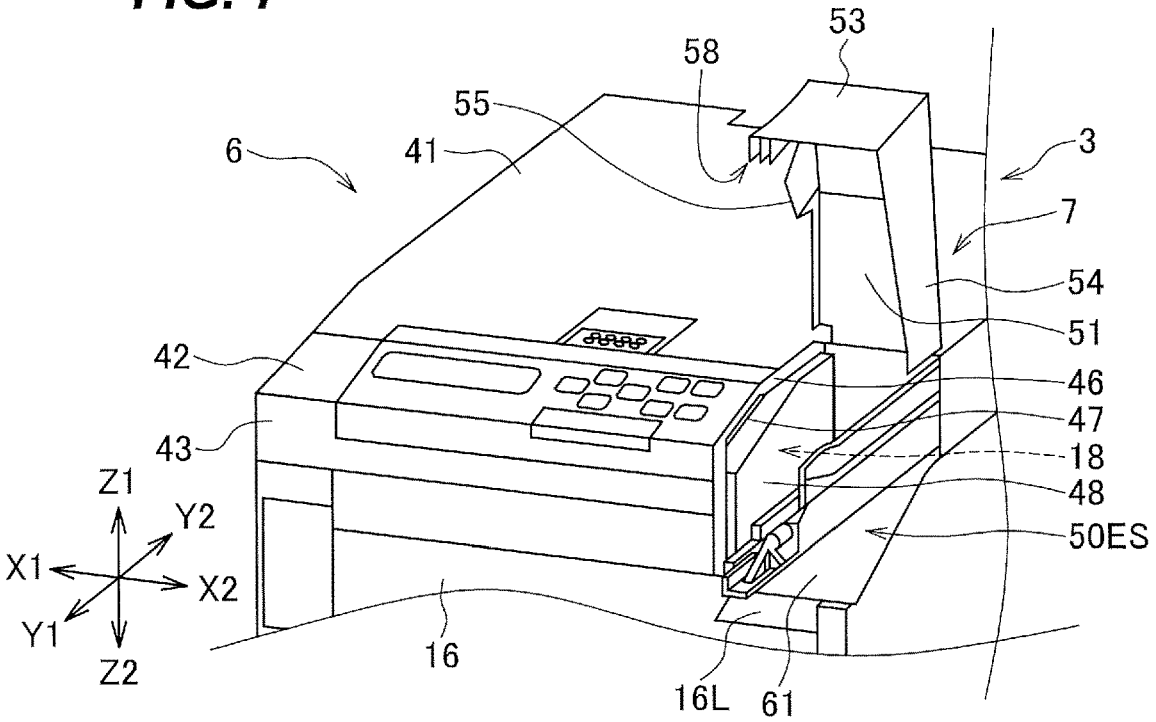
FIG. 7 is a schematic perspective view illustrating another state in which the sub cover is open.

Thus, the sub cover 7 can rotate about the sub cover rotation portion 8 relative to the main cover 6 in such a manner that a front end of the sub cover 7 moves upward and rearward, from a state (referred to below as the sub closed state) in which the upper surface of the upper portion 51 forms a continuous surface with the upper surface 41 of the main cover 6 as illustrated in FIG. 1. Specifically, the sub cover 7 can change its position up to a state in which it is rotated about 180 degrees from the sub closed state, as illustrated in FIGS. 6, 7, and 8.

Hereinafter, for convenience of description, the state in which the sub cover 7 is rotated from the sub closed state and the upper surface of the upper portion 51 and the like are separated from the upper surface 41 and the like of the main cover 6 will be referred to as the sub open state. Also, in FIG. 4, a part of the opening 50E that is closed by the main cover 6 will be referred to as the main opening 50EM, and a part of the opening 50E that is closed by the sub cover 7 will be referred to as the sub opening 50ES. Further, the sub cover rotation portion 8, about which the sub cover 7 rotates when opened and closed, may be referred to as a sub opening/closing portion.

Figure 8:
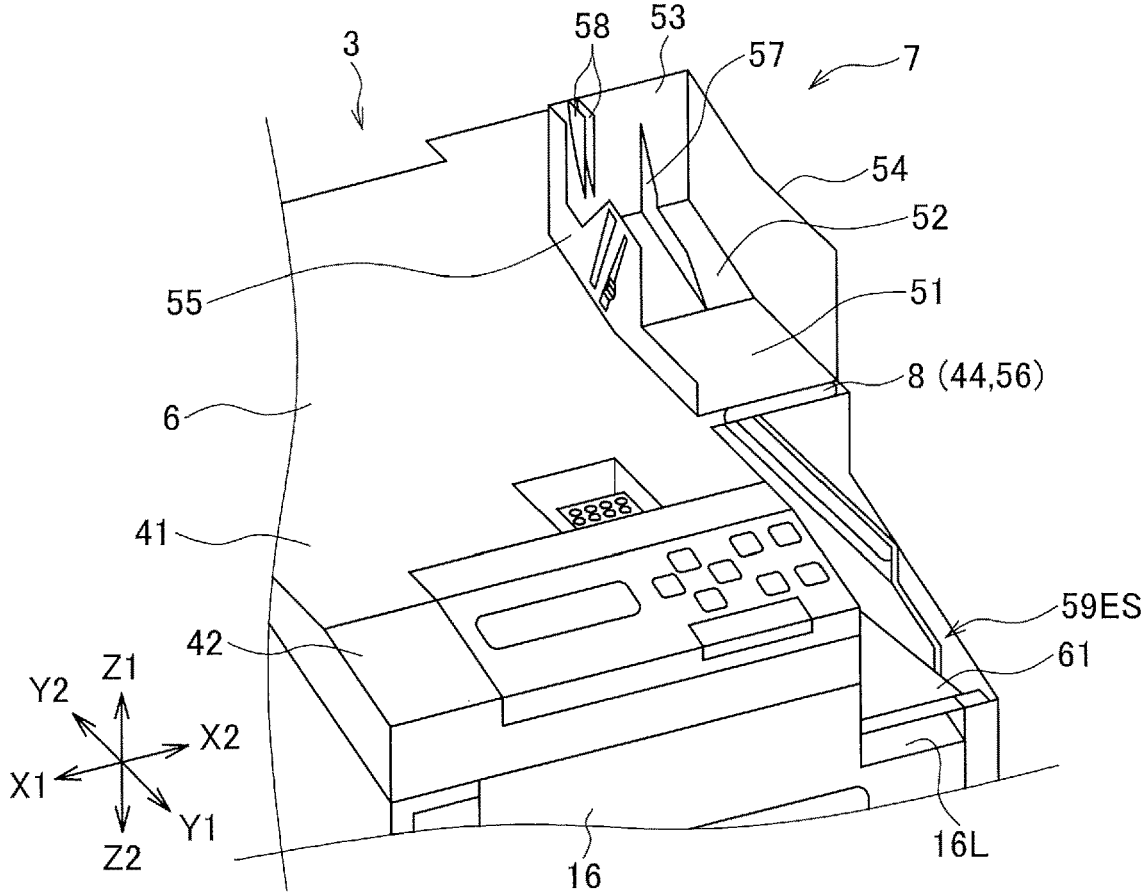
FIG. 8 is a schematic perspective view illustrating another state in which the sub cover is open.

Further, the sub cover 7 is provided with two types of ribs: a cartridge rib 57 and two lever ribs 58, as illustrated in FIG. 8. Each of the cartridge rib 57 and lever ribs 58 is substantially parallel to the right portion 54 and left portion 55, and is formed in a plate shape whose length (or thickness) in the left-right direction is relatively small (or thin).

The cartridge rib 57 stands on the inclined portion 52 and front portion 53 of the sub cover 7, near centers of the inclined portion 52 and front portion 53 in the left-right direction. The length of the cartridge rib 57 from the inclined portion 52 and the length of the cartridge rib 57 from the front portion 53 are relatively small. The two lever ribs 58 stand on the front side of the front portion 53 in FIG. 8, i.e., on the rear side of the front portion 53 in the sub closed state (see FIGS. 1 and 5), near a left end of the front portion 53, i.e., near the left portion 55, in such a manner that they are arranged along the left-right direction with a relatively narrow space therebetween. Each of the lever ribs 58 has a triangular shape elongated in the up-down direction as viewed in the left-right direction, and has a lower end, which is at the same height as a lower end of the front portion 53.

On the other hand, as illustrated in FIG. 7, the main cover 6 has an inner right surface 46 that is located to the left of the sub opening 50ES and is a side surface facing the left portion 55 (see FIG. 5) when the sub cover 7 is in the closed state (see FIG. 1). The main cover 6 is provided with a main ridge portion 47 in an area of the inner right surface 46 substantially to the right of the inclined surface 42. The main ridge portion 47 is raised rightward relative to the surrounding surface, extending along a straight line substantially parallel to the inclined surface 42.

The main cover 6 is also provided with an engagement guide plate 48 that is plate-shaped and thin in the left-right direction, at a position slightly away from and to the right of the inner right surface 46. Thus, a space extending along the front-rear direction is formed in the main cover 6 between the inner right surface 46 and the engagement guide plate 48, as viewed from above. The width (or the length in the left-right direction) of the space is slightly wider (or longer) than the thickness (or the length in the left-right direction) of the left portion 55 of the sub cover 7 (see FIG. 5). Each of the inner right surface 46, main ridge portion 47, and engagement guide plate 48 of the main cover 6 is a molded part obtained by molding a predetermined resin material, and although having a certain degree of stiffness, can elastically deform a little when subjected to a relatively large force.

Further, the main cover 6 is provided with a sub cover switch 18 (see FIGS. 2 and 5) at a position that is to the left of the engagement guide plate 48 and below the main ridge portion 47. The sub cover switch 18 includes a switch main body 18A and a switch lever 18B, as illustrated in FIG. 5.

The switch main body 18A is formed in a hollow rectangular parallelepiped shape and is widely open on its front side. The switch lever 18B is formed, as a whole, in a rectangular parallelepiped shape that is long in the front-rear direction, and is provided at its front end with a lever tip 18BT having a cylindrical shape with a central axis extending along the left-right direction. The switch lever 18B is rotatably supported at its rear end in the switch main body 18A, and can rotate about a rotation axis extending along the left-right direction in such a manner that its front end swings up and down. The switch lever 18B switches the output of the switch between "on" and "off" states depending on its position, specifically the position of the lever tip 18BT in the up-down direction.

Further, the switch lever 18B has the lever tip 18BT urged upward by a spring (not illustrated) installed in the switch main body 18A. Thus, when no external force is being applied to the switch lever 18B and the lever tip 18BT is located on the upper side, the sub cover switch 18 is "off", and only when an external force is being applied to the switch lever 18B and the lever tip 18BT is located on the lower side, the sub cover switch 18 is "on".

Even when the controller 10 (see FIG. 2) is turned on, if at least one of the main cover 6 and sub cover 7 is open and at least one of the main cover switch 17 and sub cover switch 18 is "off", the controller 10 does not start or stops operations of respective parts. Thus, the controller 10 starts or continues the operations of the respective parts only when both the main cover 6 and sub cover 7 are closed and both the main cover switch 17 and sub cover switch 18 are "on".

Figure 9B:
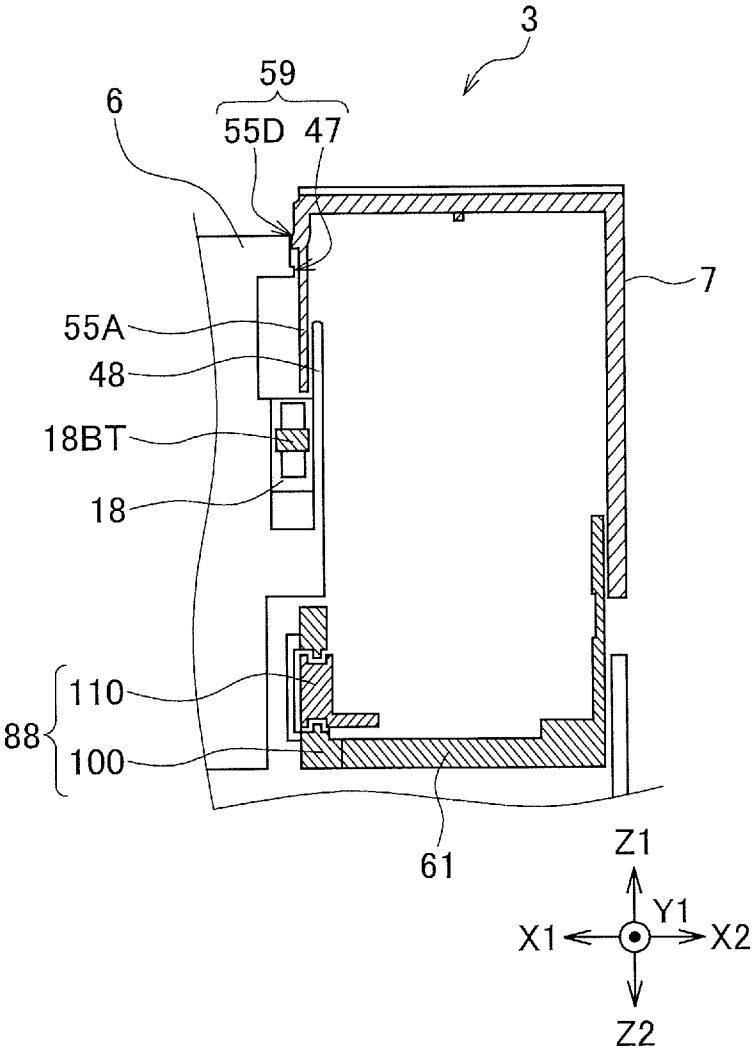
FIGS. 9A and 9B are respectively schematic side and sectional views illustrating an aspect of the cover with the sub cover open.
Figure 9A:
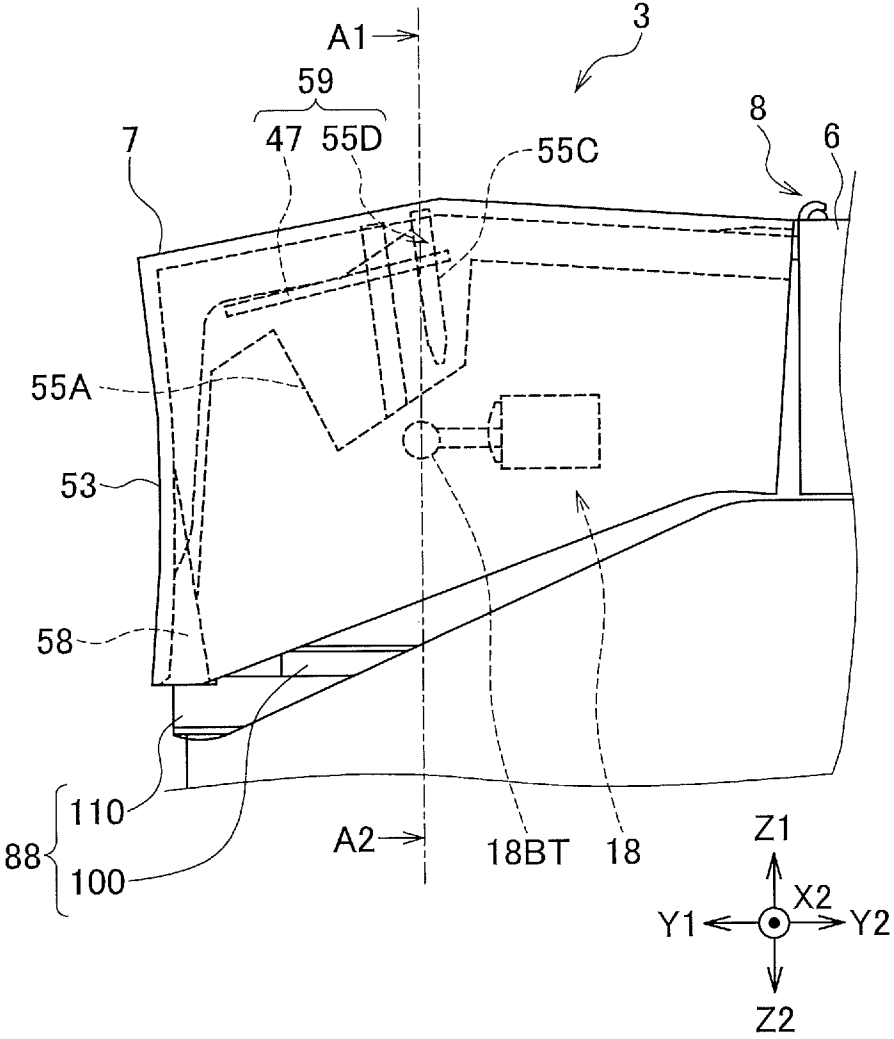

Here, it will be assumed that the sub cover 7 of the cover 3 is in the open state and is rotated about 10 to 15 degrees from the closed state, as illustrated in FIGS. 9A and 9B. FIG. 9A is a right side view, and FIG. 9B is a sectional view taken along line A1-A2 in FIG. 9A. For convenience of illustration, the toner cartridge 65 (to be described later) is omitted in FIGS. 9A and 9B.

In this state, almost the whole of the left projecting portion 55A of the sub cover 7 is inserted between the inner right surface 46 and the engagement guide plate 48 of the main cover 6, and in the left-right direction, the left projecting portion 55A nearly abuts each of the inner right surface 46 and engagement guide plate 48. Thus, the left projecting portion 55A is sandwiched between the inner right surface 46 and engagement guide plate 48 almost without gaps, restricting movement of the sub cover 7 relative to the main cover 6 in the left-right direction.

The sub projection 55D of the sub cover 7 is located above the main ridge portion 47 of the main cover 6, and is located at substantially the same position as the main ridge portion 47 in the left-right direction, as illustrated in FIG. 9B. In this state, although the sub cover 7 is subjected to a downward force by the action of gravity, since the sub projection 55D is supported from below by the main ridge portion 47, the sub cover 7 is not allowed to move (or rotate) downward from this state, maintaining the open state.

Further, a lower edge of the left projecting portion 55A of the sub cover 7 is located above the lever tip 18BT of the sub cover switch 18 in the main cover 6. Thus, the sub cover switch 18 is "off". Thus, the controller 10 (see FIG. 2) can obtain a detection signal indicating "off" from the sub cover switch 18 and recognize that the sub cover 7 is in the open state and is not closed relative to the main cover 6.

Next, it will be assumed that, in the state illustrated in FIGS. 9A and 9B, a sufficiently large downward force is applied to the upper portion 51 or inclined portion 52 of the sub cover 7. At this time, the sub cover 7 rotates about the sub cover rotation portion 8 while elastically deforming the left projecting portion 55A and the inner right surface 46 and engagement guide plate 48 of the main cover 6, and the sub projection 55D climbs over the main ridge portion 47 to reach the lower side of the main ridge portion 47.

Figure 10B:
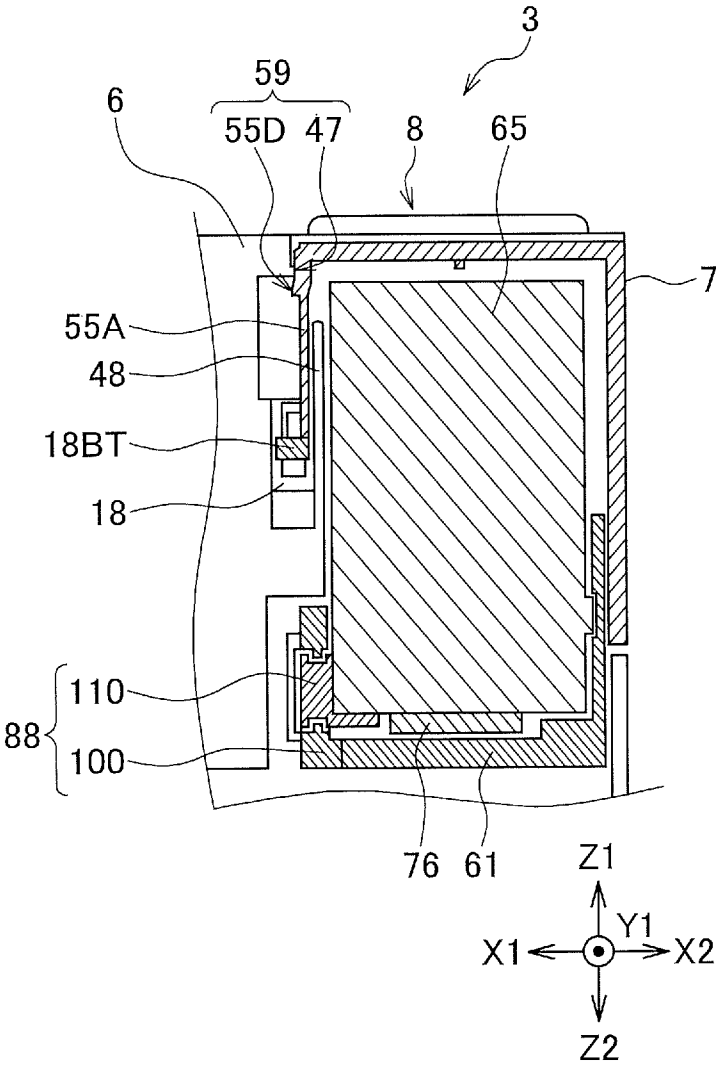
FIGS. 10A and 10B are respectively schematic side and sectional views illustrating an aspect of the cover with the sub cover closed.
Figure 10A:
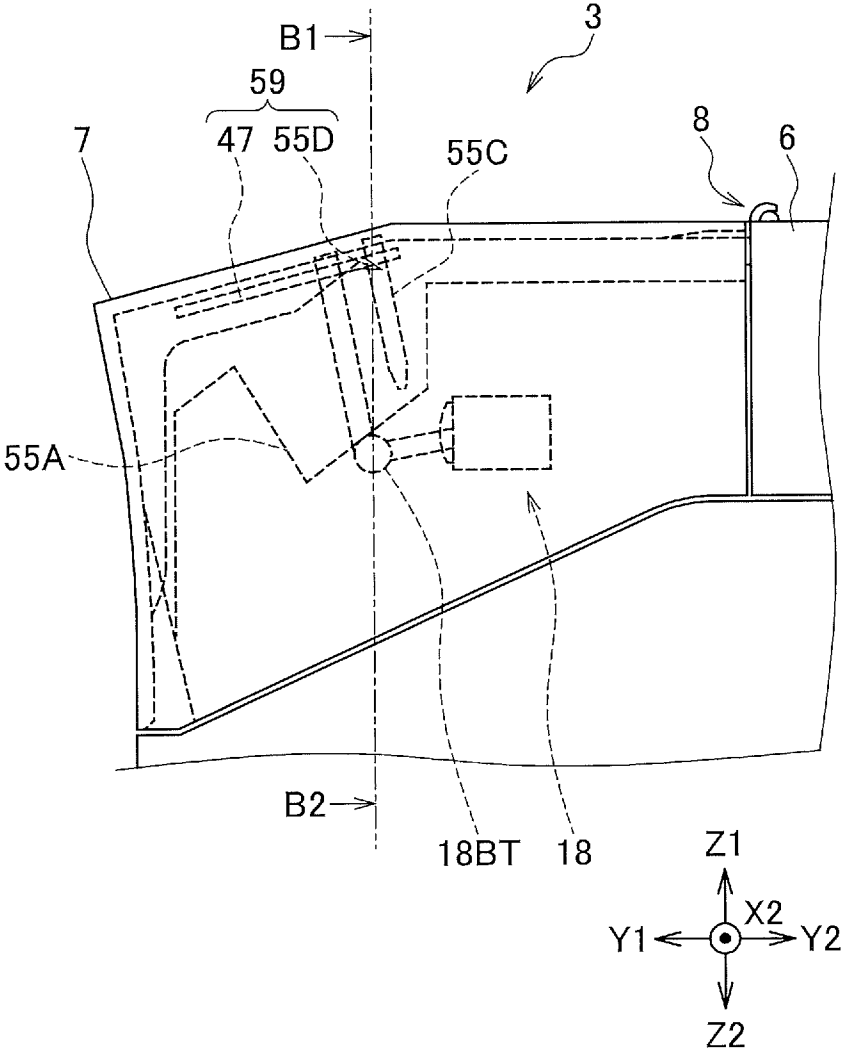

As a result, the sub cover 7 is changed to the closed state, as illustrated in FIGS. 10A and 10B. FIG. 10A is a side view corresponding to FIG. 9A, and FIG. 10B is a sectional view taken along line B1-B2 in FIG. 10A. FIGS. 10A and 10B illustrate the toner cartridge 65 (to be described later).

At this time, the lower edge of the left projecting portion 55A of the sub cover 7 comes into contact with the lever tip 18BT of the sub cover switch 18 and pushes the lever tip 18BT down. Thereby, the sub cover switch 18 changes to the "on" state and supplies a detection signal indicating this to the controller 10 (see FIG. 2). Thereby, the controller 10 can recognize that the sub cover 7 is in the sub closed state (see FIG. 1, etc.), in which the sub cover 7 is closed relative to the main cover 6.

In this closed state, the main ridge portion 47 of the main cover 6 is located on the upper side of the sub projection 55D of the sub cover 7 and restricts rotation of the sub cover 7. In other words, the main ridge portion 47 of the main cover 6 restricts rotation of the sub cover 7 via the sub projection 55D.

Thus, in the cover 3, only when a relatively great upward or rearward force is applied to the sub cover 7 and the sub projection 55D climbs over the main ridge portion 47 while elastically deforming the left projecting portion 55A and the like, the engagement between the sub projection 55D and the main ridge portion 47 is released, and the sub cover 7 is changed from the closed state (see FIGS. 10A and 10B) to the open state (see FIGS. 9A and 9B). Hereinafter, for convenience of description, the sub projection 55D and main ridge portion 47 for engaging the sub cover 7 with the main cover 6 will be referred to collectively as the cover engagement unit 59.

The front panel 16 (see FIG. 1) of the main body 2 has a front panel inclined portion 16L, which is formed in a right upper part of the front panel 16 or a part of the front panel 16 forming a front lower part of the sub opening 50ES (see FIG. 6, etc.). The front panel inclined portion 16L is located near a position that is extremely close to the lower end of the front portion 53 when the sub cover 7 is in the closed state (see FIG. 1, etc.). The front panel inclined portion 16L is formed by an inclined surface that is inclined rearward relative to the vertical direction.

Thereby, in the image forming apparatus 1, when the main cover 6 and sub cover 7 are both in the closed state (see FIG. 1), a sub cover lower space 16S, which is a space recessed rearward from a front surface of the front panel 16, is formed on the lower side of the front portion 53 of the sub cover 7. The upper side of the sub cover lower space 16S is covered by the front portion 53 of the sub cover 7.

The image forming apparatus 1 allows, for example, a user to insert the tip of a finger or the like into the sub cover lower space 16S and apply an upward and rearward force to the front portion 53 of the sub cover 7 located above and adjacent to the sub cover lower space 16S. Thus, in the image forming apparatus 1, the sub cover 7 can be changed from the closed state (FIGS. 10A and 10B) to the open state (FIGS. 9A and 9B) and further continuously rotated to an angle of about 180 degrees by an extremely simple operation (see FIGS. 6, 7, and 8).

3. Configuration of Image Forming Unit

Figure 11:
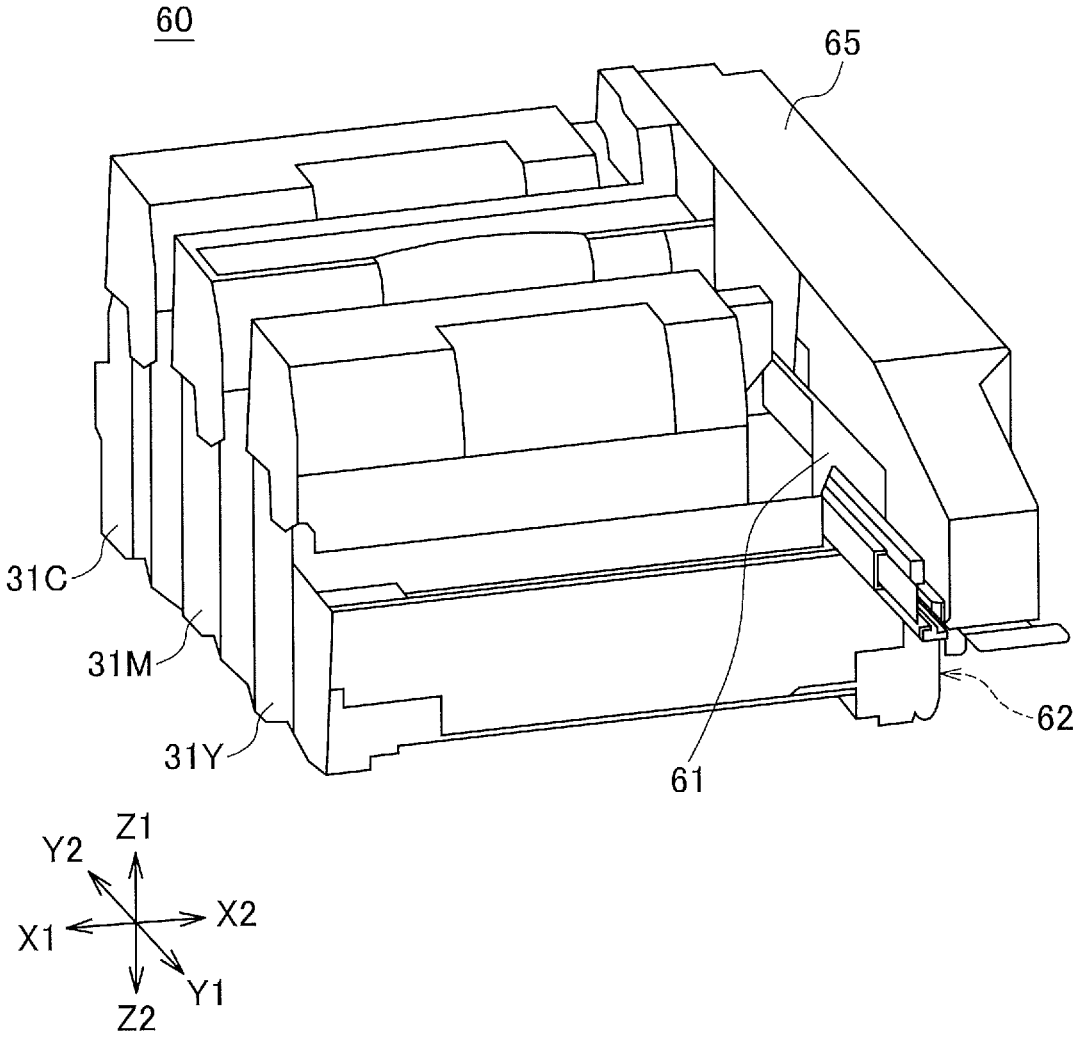
FIG. 11 is a schematic perspective view illustrating a configuration of an image forming unit.

As described above, various units are installed in the internal space 50S of the housing 50 of the image forming apparatus 1 (see FIG. 4). One of the units is an image forming unit 60. As illustrated in FIG. 11, the image forming unit 60 is constituted by the developing drum units 31 (31C, 31M, and 31Y) for the three colors arranged in the front-rear direction, a stage 61 disposed on upper parts of the right sides of the developing drum units 31, and a toner conveying portion 62 disposed on the lower side of the stage 61. The toner cartridge 65 containing the toners of the respective colors can be attached to and detached from the stage 61.

When the image forming unit 60 is mounted in the housing 50, the stage 61 is located behind the sub opening 50ES formed by opening of the sub cover 7, as illustrated in FIGS. 4, 7, 8, etc.

<3-1. Configuration of Toner Cartridge>

Figure 12A:
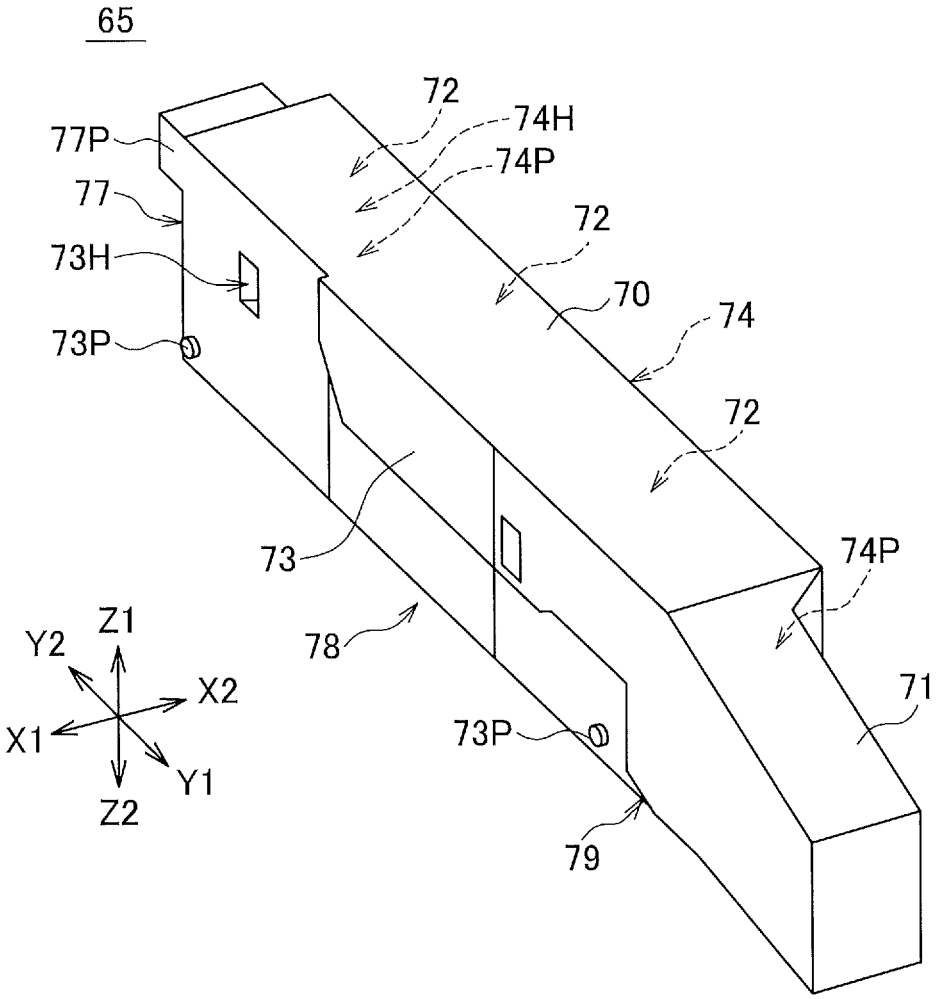
FIGS. 12A and 12B are schematic perspective views illustrating a configuration of a toner cartridge.
Figure 12B:
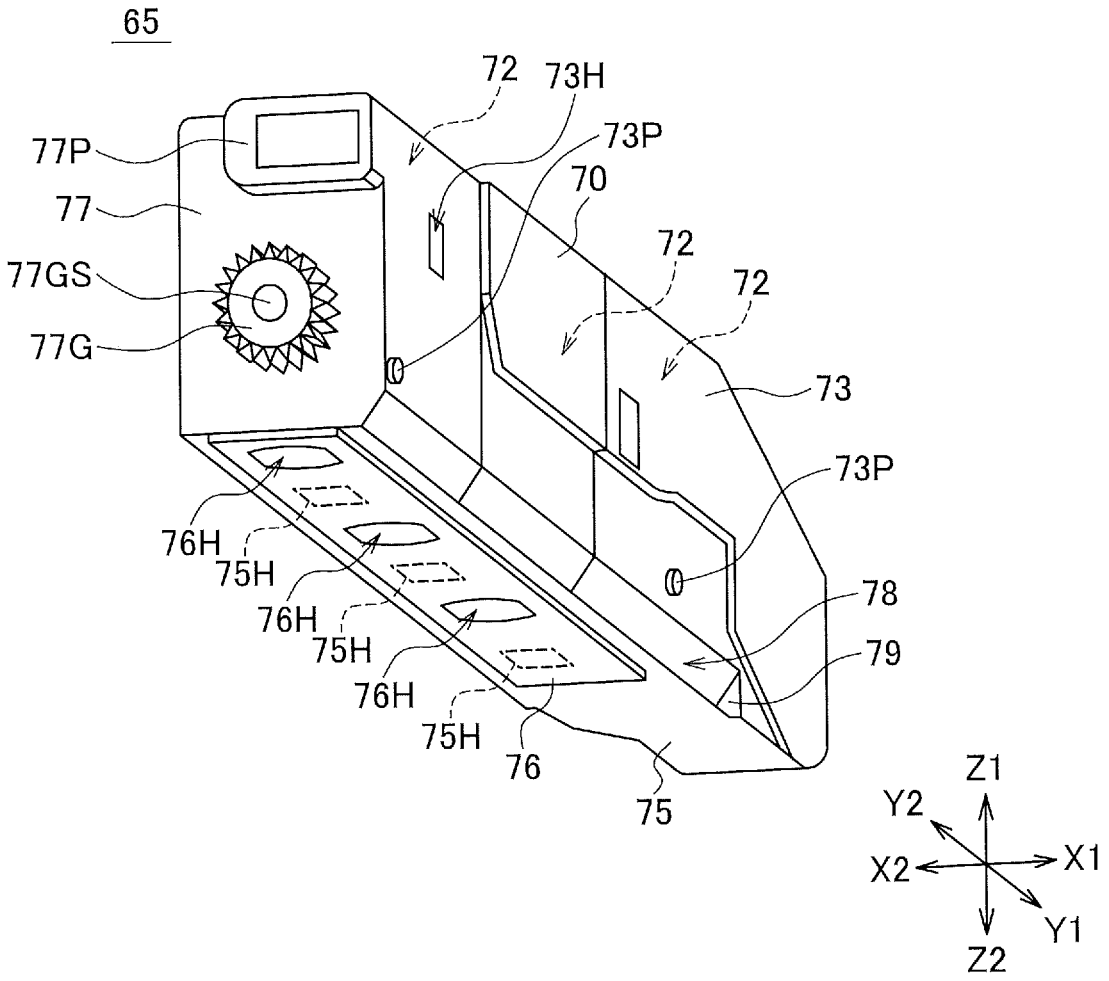

Next, a configuration of the toner cartridge 65 will be described. As illustrated in FIGS. 12A and 12B, the toner cartridge 65, serving as a detachable part, is formed, as a whole, in a rectangular parallelepiped shape that is sufficiently long in the front-rear direction and is slightly longer in the up-down direction than in the left-right direction.

The toner cartridge 65 is mainly constituted by a toner cartridge housing 70. For example, the toner cartridge housing 70 is formed in a hollow rectangular parallelepiped shape by appropriately combining multiple types of molded parts obtained by molding a predetermined resin material. However, the toner cartridge housing 70 has a shape obtained by obliquely cutting off a front upper part of a rectangular parallelepiped shape, and has an inclined surface that extends upward as it extends rearward and is formed in the upper approximately one-third of the front approximately one-fourth of the toner cartridge housing 70.

The inside of the toner cartridge housing 70 is partitioned by inner walls into four spaces approximately equally in the front-rear direction. A part of the toner cartridge housing 70 corresponding to the frontmost of the four spaces is formed as a handle 71 with its right side open, and allows fingertips of a user or the like to hold an inclined upper plate, a front plate, a left plate, or the like of the part.

The remaining three spaces of the four partitioned spaces, which correspond to the rear approximately three-fourths of the toner cartridge housing 70, are each a toner storage 72 for storing toner, which is powder, and store toners of yellow (Y), magenta (M), and cyan (C) in order from the front.

The toner cartridge housing 70 has a left plate 73 having a left surface. Although the left surface is generally flat, the entire rear approximately one-fourth of the left surface and a lower part of the central approximately one-half of the left surface are recessed rightward relative to the other part of the left surface, and a step is formed in the boundary portion. A holder engagement hole 73H, which is recessed rightward relative to the surrounding surface, is formed at a position that is in the rear approximately one-fourth of the left plate 73, near a center of the rear approximately one-fourth in the front-rear direction, and slightly above the center. The holder engagement hole 73H is a relatively small space having a rectangular parallelepiped shape.

Further, two positioning projections 73P projecting leftward are disposed to stand on the left plate 73 near a lower end of the left plate 73. One of them is slightly behind a position separated from a front end of the left plate 73 by a distance equal to approximately one-fourth of the length of the left plate 73, and the other is slightly in front of a rear end of the left plate 73. The positioning projections 73P are each formed in a small cylindrical shape with a central axis extending along the left-right direction.

The toner cartridge housing 70 has a right plate 74 that is disposed behind the handle 71, which is the front approximately one-fourth of the toner cartridge housing 70, and has a right surface that is generally flat. Also, two positioning projections 74P are disposed to stand on the right plate 74 near a lower end of the right plate 74. The positions of the two positioning projections 74P on the right plate 74 are generally bilaterally symmetrical with those of the two positioning projections 73P on the left plate 73, and the shapes of the positioning projections 74P are generally bilaterally symmetrical with those of the positioning projections 73P. Also, a holder engagement hole 74H is provided in the right plate 74. The holder engagement hole 74H is to the right of and slightly behind the holder engagement hole 73H. The shape of the holder engagement hole 74H is generally bilaterally symmetrical with that of the holder engagement hole 73H.

The toner cartridge housing 70 has a lower plate 75. Although the lower plate 75 is formed generally in a flat plate shape, three toner supply openings 75H passing through the lower plate 75 in the up-down direction are formed in the lower plate 75, substantially at centers of respective bottoms of the three toner storages 72. The toner supply openings 75H may be referred to simply as supply openings.

A shutter 76 is disposed on the lower side of the lower plate 75. The shutter 76 is disposed on the lower side that is one of the sides of the toner cartridge 65. The shutter 76 is formed, as a whole, in a thin plate shape that is thin in the up-down direction and long in the front-rear direction. With a movement mechanism (not illustrated), the shutter 76 can move (or slide) relative to the lower plate 75 within a predetermined movement range in the front-rear direction.

Three passing openings 76H passing through the shutter 76 in the up-down direction are formed in the shutter 76 at three positions spaced at predetermined intervals in the front-rear direction. When the shutter 76 is in its rearmost position within the movable range (see FIG. 12B), the shutter 76 closes the toner supply openings 75H of the lower plate 75 with flat plate-shaped portions in which the passing openings 76H are not formed. This state will be referred to below as the shutter closed state. Thereby, the toner cartridge 65 can separate the toner storages 72 from the outside and seal the toners of the respective colors contained in the respective toner storages 72.

On the other hand, when the shutter 76 is in its frontmost position within the movable range, the passing openings 76H coincide with the respective toner supply openings 75H, thereby opening the toner supply openings 75H. This state will be referred to below as the shutter open state. Thereby, the toner cartridge 65 can supply the toners of the respective colors contained in the respective toner storages 72, to the outside.

The shutter 76 is urged rearward by an urging member (not illustrated). Also, in the shutter closed state (see FIG. 12B), the shutter 76 is restricted from moving forward, by a lock mechanism (not illustrated). Thus, the toner cartridge 65 can maintain the shutter closed state, in which the toner storages 72 are sealed by the shutter 76, when no external force is applied to the shutter 76 or when an external force of a certain magnitude is applied to the shutter 76.

The toner cartridge housing 70 has a rear plate 77. Although the rear plate 77 is formed generally in a flat plate shape, a left upper part of the rear plate 77 projects rearward relative to the other part to form a projecting portion 77P. The projecting portion 77P is provided with electrodes (not illustrated), a memory circuit that stores information regarding the toner cartridge 65, or the like.

Also, the rear plate 77 is provided with a gear 77G, which is substantially at a center of the rear plate 77 in the left-right direction and is slightly below a center of the rear plate 77 in the up-down direction. The gear 77G is attached to a rear end of a gear shaft 77GS extending along the front-rear direction. The gear shaft 77GS sequentially passes through the three toner storages 72, and is rotatably supported by the rear plate 77, partition plates partitioning the toner storages 72, and the like. An agitating member is attached to the gear shaft 77GS in each toner storage 72. Thus, when a driving force is externally applied to the gear 77G of the toner cartridge 65, the gear shaft 77GS rotates, thereby agitating the toners contained in the three respective toner storages 72.

A left lower inclined portion 78 is formed in a left lower part, or a connecting part between the left plate 73 and the lower plate 75, of the toner cartridge housing 70. The left lower inclined portion 78 extends over a wide range from a rear end to near a front end of the toner cartridge housing 70, and is shaped as if the corner had been obliquely cut off. Also, a link rear surface 79 is formed at a front end of the left lower inclined portion 78, or slightly behind the front end of the toner cartridge housing 70. The link rear surface 79 is a flat surface substantially parallel to a rear surface of the rear plate 77, and is in the shape of a right triangle as viewed from the rear. The link rear surface 79 may be referred to as a link portion.

<3-2. Configuration of Stage>

<3-2-1. Entire Configuration of Stage>

Figure 13:
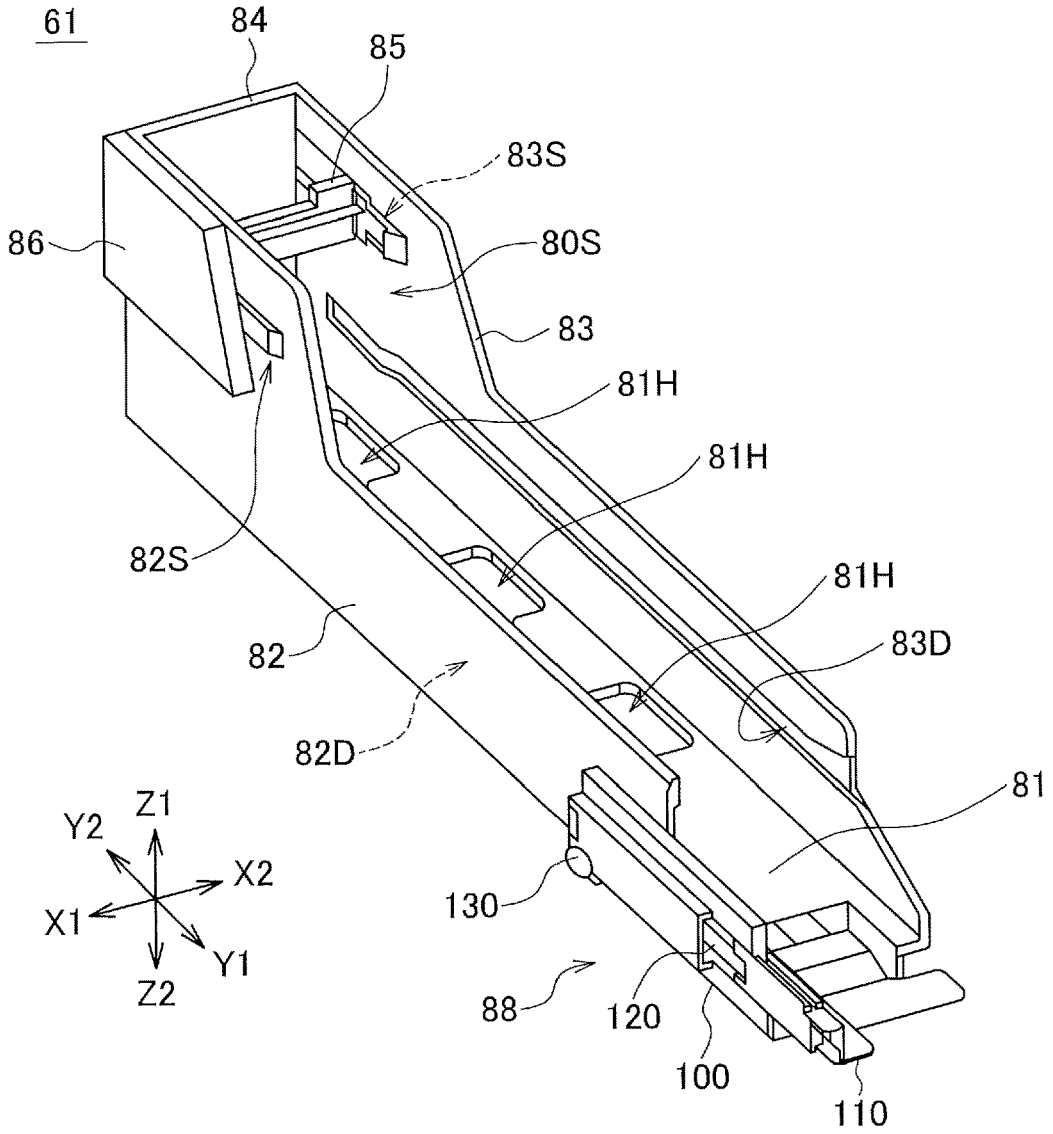
FIG. 13 is a schematic perspective view illustrating a configuration of a stage.

Next, a configuration of the stage 61 will be described. FIG. 13 is a schematic perspective view of the stage 61. As illustrated in FIG. 13, the stage 61 is formed, as a whole, in a hollow rectangular parallelepiped shape that is open on its upper and front sides. The stage 61 includes a lower plate 81, a left plate 82, a right plate 83, and a rear plate 84 that are respectively disposed on the lower, left, right, and rear sides of an attachment space 80S in the shape of a rectangular parallelepiped.

The stage 61 is slightly greater than the toner cartridge 65 (see FIGS. 12A and 12B) in length in the up-down direction and left-right direction, and is equal to or slightly less than the toner cartridge 65 in length in the front-rear direction.

The attachment space 80S is slightly greater than the toner cartridge 65 in length in the up-down direction and left-right direction, and is slightly less than the toner cartridge 65 in length in the front-rear direction.

The lower plate 81 is formed in a plate shape that is thin in the up-down direction. Three through-holes 81H passing through the lower plate 81 in the up-down direction are formed in the lower plate 81, at three positions substantially to the right of the respective developing drum units 31 (31C, 31M, and 31Y) for the three colors illustrated in FIG. 11.

The left plate 82 is formed in a plate shape that is thin in the left-right direction. The left plate 82 is connected at its lower end to a left end of the lower plate 81. The upper approximately one-half of the front approximately two-thirds of the left plate 82 is cut off, forming a shape corresponding to the step formed in the left plate 73 of the toner cartridge 65 (see FIGS. 12A and 12B).

A right surface, i.e., a surface on the attachment space 80S side, of the left plate 82 is generally flat as a whole. However, a left guide groove 82D recessed leftward relative to the surrounding surface is formed in the left plate 82. The left guide groove 82D is formed at a position (or height) slightly separated from the lower end of the left plate 82 in the up-down direction to extend generally along the front-rear direction from a front end to near a rear end of the left plate 82. Thus, the left guide groove 82D is formed substantially in the shape of a horizontal straight line. A groove width, i.e., the length in the up-down direction, of the left guide groove 82D is slightly greater (or longer) than diameters (i.e., the lengths in the up-down direction) of the positioning projections 73P disposed on the left plate 73 of the toner cartridge 65 (see FIGS. 12A and 12B).

A left slide hole 82S passing through the left plate 82 in the left-right direction is formed in the rear approximately one-fourth of the left plate 82, slightly above a center of the left plate 82 in the up-down direction. The left slide hole 82S is formed in a rectangular parallelepiped shape that is elongated along the front-rear direction. A rail (not illustrated) extending along the front-rear direction is formed in each of upper and lower inner surfaces of the left slide hole 82S.

The right plate 83 is formed in a plate shape that is thin in the left-right direction. The right plate 83 is connected at its lower end to a right end of the lower plate 81. The right plate 83 is generally bilaterally symmetrical with the left plate 82. A left surface, i.e., a surface on the attachment space 80S side, of the right plate 83 is generally flat as a whole. However, a right guide groove 83D recessed rightward relative to the surrounding surface is formed in the right plate 83. The right guide groove 83D is generally bilaterally symmetrical with the left guide groove 82D of the left plate 82.

A right slide hole 83S passing through the right plate 83 in the left-right direction is formed in the rear approximately one-fifth of the right plate 83, slightly above a center of the right plate 83 in the up-down direction. The position of the right side hole 83S is substantially bilaterally symmetrical with the position of the left slide hole 82S of the left plate 82. However, the right slide hole 83S is shorter than the left slide hole 82S in the front-rear direction. As in the left slide hole 82S, a rail (not illustrated) extending along the front-rear direction is formed in each of upper and lower inner surfaces of the right slide hole 83S.

The rear plate 84 is formed in a plate shape that is thin in the front-rear direction. The rear plate 84 is connected at its lower end to a rear end of the lower plate 81, and is connected at its left and right ends to a rear end of the left plate 82 and a rear end of the right plate 83, respectively. The rear plate 84 is provided with a gear, a connection terminal, and the like, which are not illustrated.

Also, in the stage 61, a toner cartridge holder 85 is installed in the left slide hole 82S of the left plate 82 and the right slide hole 83S of the right plate 83, and an urging mechanism 86 is provided on the left side of the left slide hole 82S of the left plate 82.

Figure 14:
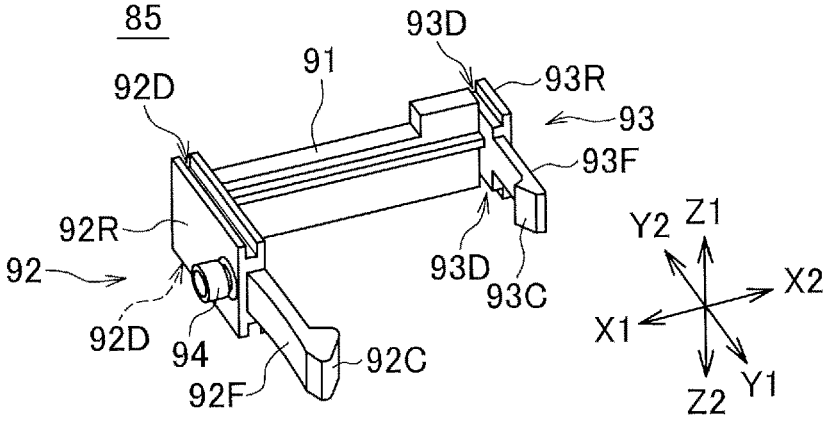
FIG. 14 is a schematic perspective view illustrating a configuration of a toner cartridge holder.

FIG. 14 is a schematic perspective view of the toner cartridge holder 85. As illustrated in FIG. 14, the toner cartridge holder 85 is roughly constituted by a rear portion 91, a left portion 92, and a right portion 93. The rear portion 91 is formed in a rectangular parallelepiped shape that is long in the left-right direction and short (or thin) in the front-rear direction. A rear end of the left portion 92 is connected to a left end of the rear portion 91, and a rear end of the right portion 93 is connected to a right end of the rear portion 91.

The left portion 92 is constituted by a left rear portion 92R on the rear side and a left front portion 92F on the front side. The left rear portion 92R is formed in a rectangular parallelepiped shape that is long in the front-rear direction and short (or thin) in the left-right direction. A groove 92D recessed relative to the surrounding surface is formed along the front-rear direction in each of upper and lower surfaces of the left rear portion 92R. The groove 92D in the upper surface is formed near a center of the upper surface in the left-right direction, and the groove 92D in the lower surface is formed near a center of the lower surface in the left-right direction. The left front portion 92F is formed in a rectangular parallelepiped shape that is shorter (or thinner) than the left rear portion 92R in the up-down direction and left-right direction. An engagement claw 92C is disposed on a right surface (or inner surface) of a front end of the left front portion 92F to project rightward. The engagement claw 92C is formed in a triangular shape with a vicinity of a tip of the left front portion 92F as one side, as viewed in the up-down direction. Further, a short cylindrical post 94 is disposed on a left surface of the left rear portion 92R near a front end of the left surface to project leftward.

As with the left portion 92, the right portion 93 is constituted by a right rear portion 93R on the rear side and a right front portion 93F on the front side. The right rear portion 93R is substantially equal in length to the left rear portion 92R in the up-down direction, equal in length to approximately two-thirds of the left rear portion 92R in the left-right direction, and equal in length to approximately one-half to approximately one-third of the left rear portion 92R in the front-rear direction. The left approximately one-half of each of upper and lower surfaces of the right rear portion 93R is recessed along the front-rear direction, forming a groove 93D between the right rear portion 93R and the rear portion 91. The shape of the right front portion 93F is similar to a shape obtained by laterally inverting the left front portion 92F. The right front portion 93F is formed in a rectangular parallelepiped shape that is shorter (or thinner) than the right rear portion 93R in the up-down direction and left-right direction. An engagement claw 93C is disposed on a left surface (or inner surface) of a front end of the right front portion 93F to project leftward.

The toner cartridge holder 85 is a molded part obtained by molding a predetermined resin material, and can elastically deform when subjected to an external force of a certain magnitude. For example, when a leftward external force is applied to the vicinity of a front end of the left front portion 92F and a rightward external force is applied to the vicinity of a front end of the right front portion 93F, the toner cartridge holder 85 deforms to increase the space between the left front portion 92F and the right front portion 93F, and when the external forces are removed, the toner cartridge holder 85 elastically returns to its original shape.

The toner cartridge holder 85 is installed in the stage 61 (see FIG. 13) in a state in which the left portion 92 is fitted in the left slide hole 82S of the left plate 82 and the right portion 93 is fitted in the right slide hole 83S of the right plate 83. At this time, the upper and lower rails in the left slide hole 82S are respectively fitted in the upper and lower grooves 92D in the left portion 92, and the upper and lower rails in the right slide hole 83S are respectively fitted in the upper and lower grooves 93D in the right portion 93. This allows the toner cartridge holder 85 to move (or slide) in the front-rear direction within a range in which the left portion 92 is located in the left slide hole 82S and the right portion 93 is located in the right slide hole 83S, in a state in which the position of the toner cartridge holder 85 is restricted in the up-down direction and left-right direction.

The urging mechanism 86 is disposed on a rear upper part of the left plate 82. Specifically, the urging mechanism 86 is disposed to the left of the left slide hole 82S to cover a large part of the left slide hole 82S. The urging mechanism 86 is installed therein with a spring (not illustrated) having a predetermined shape, and one end of the spring is wound around the post 94 (see FIG. 14) of the toner cartridge holder 85. Thereby, the toner cartridge holder 85 is urged forward within the front approximately one-half of the movement range of the toner cartridge holder 85 in the front-rear direction, and is urged rearward within the rear approximately one-half of the movement range.

<3-2-2. Configuration of Insertion Unit>

An insertion unit 88 is mounted to the lower side of the left plate 82 of the stage 61 (see FIG. 13), near a front end of the left plate 82. The insertion unit 88 is constituted by a slide guide 100, a lever 110, and a spring 120. The spring 120 is a coil spring.

Figure 15A:
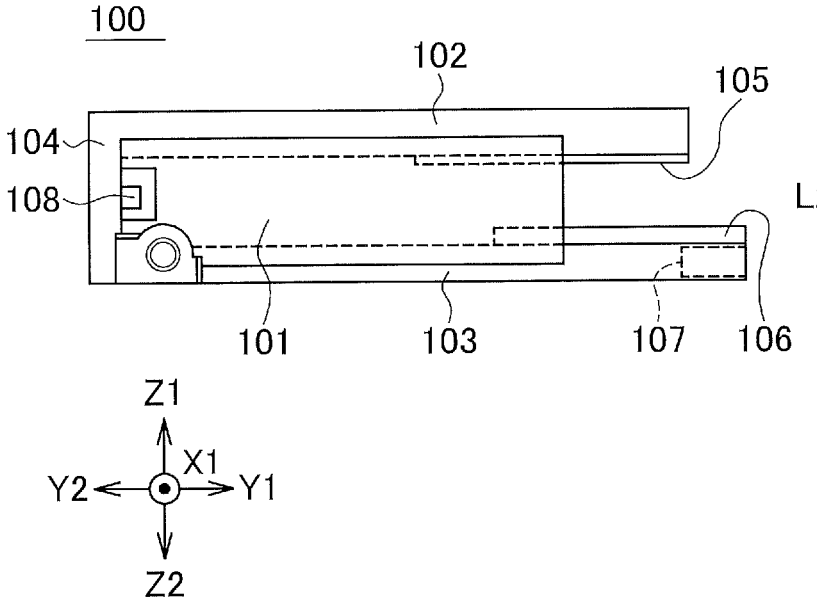
FIGS. 15A and 15B are schematic views illustrating a configuration of a slide guide.
Figure 15B:
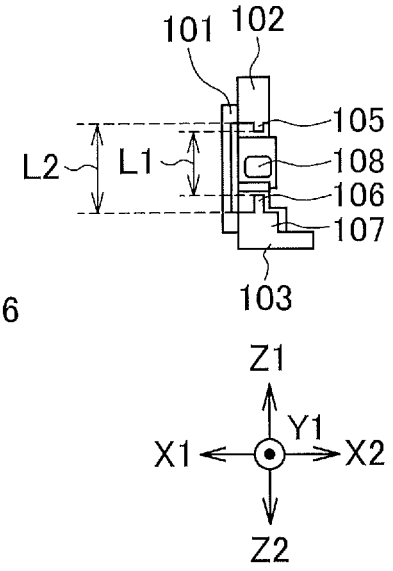

FIG. 15A is a schematic left side view of the slide guide 100, and FIG. 15B is a schematic front view of the slide guide 100. As illustrated in FIGS. 15A and 15B, the slide guide 100 is roughly constituted by a central portion 101, an upper portion 102, a lower portion 103, and a rear portion 104. The central portion 101 is formed in a thin plate shape or rectangular parallelepiped shape that is long in the front-rear direction and short in the left-right direction. The central portion 101 is connected to the upper portion 102 and lower portion 103, on the right side of the central portion 101, near upper and lower ends of the central portion 101, respectively. As illustrated in FIG. 13, the length of the central portion 101 is approximately one-fourth of the entire left plate 82, in the front-rear direction.

The upper portion 102 (see FIGS. 15A and 15B) is formed in a rectangular parallelepiped shape or quadrangular prism shape that is slightly longer in the front-rear direction, shorter in the up-down direction, and slightly longer in the left-right direction than the central portion 101. An upper rail 105 is disposed on a lower surface of the upper portion 102 to project downward. In the front-rear direction, the upper rail 105 extends from a front end of the lower surface of the upper portion 102 rearward for approximately two-fifths of the lower surface of the upper portion 102. In the left-right direction, the upper rail 105 lies in an area that is in the vicinity of a center of the lower surface and extends for approximately one-third of the lower surface.

The lower portion 103 is formed, as a whole, in a rectangular parallelepiped shape or quadrangular prism shape that is longer than the upper portion 102 in the front-rear direction and has its right lower portion extended rightward. A lower rail 106 is disposed on an upper surface of the lower portion 103 to project upward. In the front-rear direction, the lower rail 106 extends from a front end of the upper surface of the lower portion 103 rearward for approximately one-third of the upper surface of the lower portion 103. In the left-right direction, the lower rail 106 lies in an area that is in the vicinity of a center of the upper surface and extends for approximately one-third of the upper surface, or directly below the upper rail 105.

Thus, the slide guide 100 forms, on the right side of the central portion 101, a space defined between the upper portion 102 and the lower portion 103 in the up-down direction, and in a front part of the space, the upper rail 105 and lower rail 106 face each other and are slightly offset from each other in the front-rear direction. Further, a stopper 107 is disposed on a right surface of the lower portion 103, near a front end of the right surface. The stopper 107 projects rightward relative to the other part. The rear portion 104 is formed in a rectangular parallelepiped shape elongated along the up-down direction. The rear portion 104 is connected to a rear end of the upper portion 102 and a rear end of the lower portion 103, at upper and lower portions of a front surface of the rear portion 104, respectively. A spring support 108 is disposed on the front surface of the rear portion 104. The spring support 108 has a cylindrical shape with a central axis extending along the front-rear direction, and is located substantially at a center of the front surface in the up-down direction. An opening passing through the central portion 101 in the left-right direction is formed in a portion of the central portion 101 located near and to the left of the spring support 108.

Figure 16A:
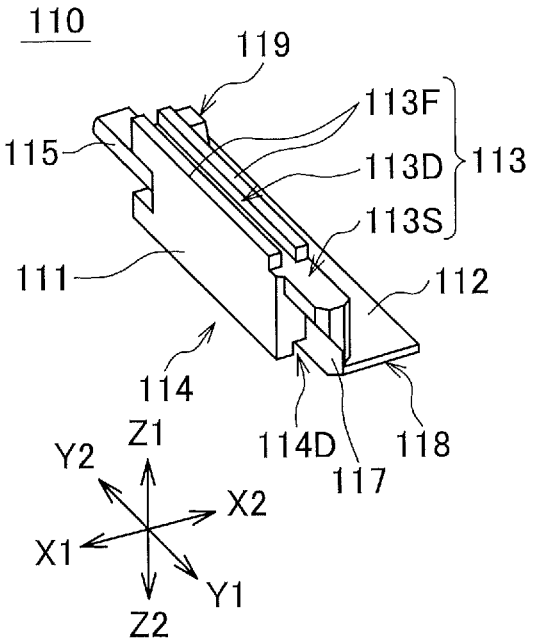
FIGS. 16A and 16B are schematic perspective views illustrating a configuration of a lever.
Figure 16B:
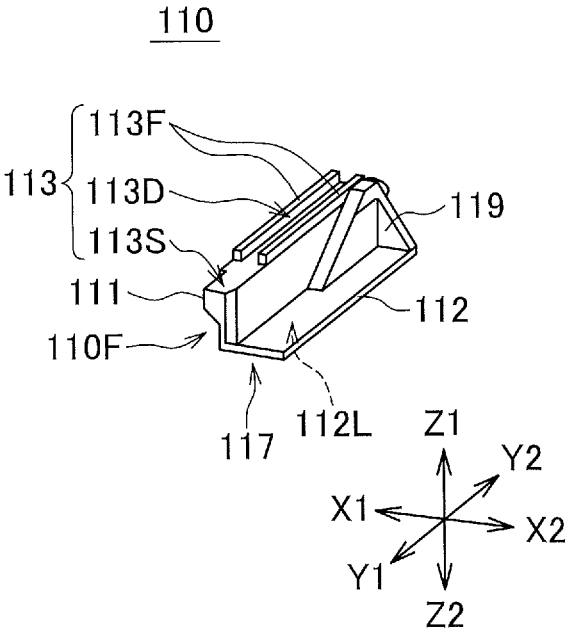
Figure 17A:
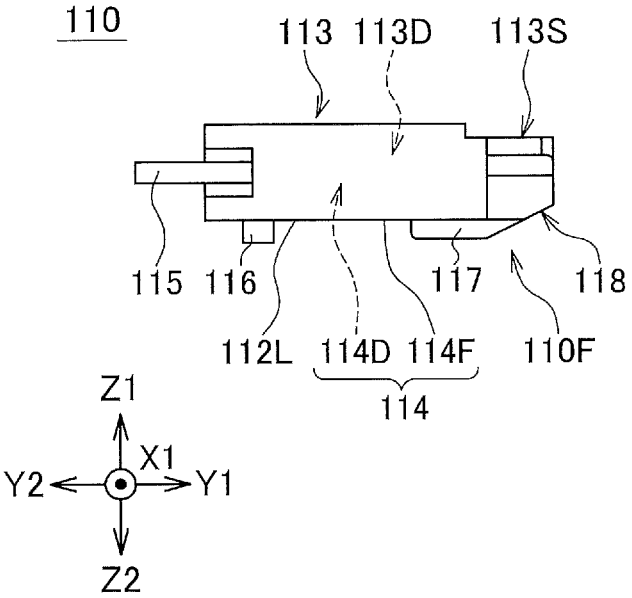
FIGS. 17A and 17B are schematic views illustrating the configuration of the lever.
Figure 17B:
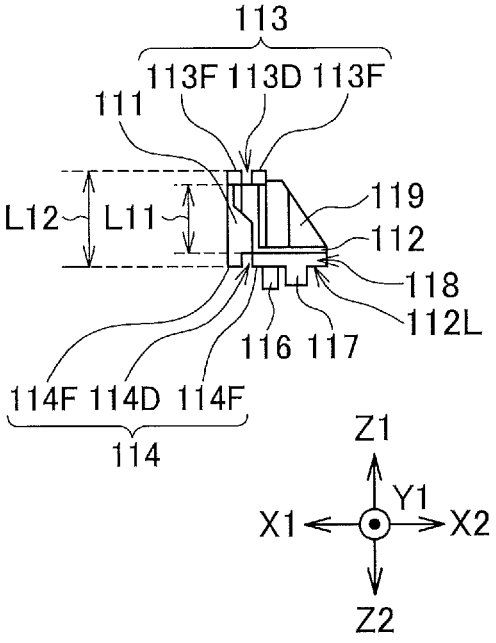

FIGS. 16A and 16B are perspective views of the lever 110 as viewed from different directions. FIGS. 17A and 17B are a left side view and a front view of the lever 110, respectively. As illustrated in FIGS. 16A, 16B, 17A, and 17B, as a whole, the lever 110 is longer in the front-rear direction than in the up-down direction and left-right direction, and has a shape like a combination of multiple rectangular parallelepiped shapes. The lever 110 is roughly constituted by a left upper portion 111 that occupies a left upper part of the lever 110, and a right lower portion 112 that occupies a right lower part of the lever 110.

The left upper portion 111 has, as a whole, a rectangular parallelepiped shape that is shorter in the up-down direction than in the front-rear direction and shorter in the left-right direction than in the up-down direction. The left upper portion 111 has an upper surface 113, which has an upper abutment surface 113S, upper flange portions 113F, and an upper groove 113D. The upper abutment surface 113S occupies the front approximately one-fourth of the upper surface 113. The upper flange portions 113F and upper groove 113D are formed in the area of the upper surface 113 other than the upper abutment surface 113S, i.e., in the area of the upper surface 113 from its central portion to its rear end. The upper flange portions 113F are disposed on both the left and right sides of the upper surface 113. The upper groove 113D is formed between the upper flange portions 113F in the left-right direction, and recessed downward relative to the upper flange portions 113F. The upper groove 113D occupies the central approximately one-third of the upper surface 113 in the left-right direction. A bottom surface of the upper groove 113D forms a continuous uniform flat surface together with the upper abutment surface 113S in front of the bottom surface.

In other words, in the upper surface 113 of the left upper portion 111, the upper flange portions 113F are omitted in the front approximately one-fourth of the upper surface 113, thereby forming the upper abutment surface 113S that is a flat surface at the same height as the bottom surface of the upper groove 113D. The length of the upper abutment surface 113S in the left-right direction is greater than the distance between the left portion 55 and the lever ribs 58 and the distance between the two lever ribs 58 of the sub cover 7 (see FIGS. 5, 8, etc.). Hereinafter, for convenience of description, an area in the vicinity of a front end of the lever 110 in which the upper abutment surface 113S is formed will be referred to as the lever front end portion 110F.

A lower groove 114D is formed in a lower surface of the left upper portion 111, directly below the upper groove 113D, in such a manner that the lower groove 114D is substantially vertically symmetrical with the upper groove 113D. The lower groove 114D is recessed upward relative to lower flange portions 114F adjacent to the lower groove 114D. The lower flange portions 114F are formed on both the left and right sides of the lower surface of the left upper portion 111. Here, a distance L12 from upper surfaces of the upper flange portions 113F to lower surfaces of the lower flange portions 114F in the lever 110 (see FIGS. 17A and 17B) is greater than a distance L1 from a lower surface of the upper rail 105 to an upper surface of the lower rail 106 in the slide guide 100 (see FIGS. 15A and 15B), and is less than a distance L2 from a lower surface of the upper portion 102 to an upper surface of the lower portion 103. Also, a distance L11 from the bottom surface of the upper groove 113D to the bottom surface (or upper surface) of the lower groove 114D in the lever 110 (see FIGS. 17A and 17B) is less than the distance L1 from the lower surface of the upper rail 105 to the upper surface of the lower rail 106 in the slide guide 100 (see FIGS. 15A and 15B).

A spring support 115 is disposed on a rear surface of the left upper portion 111, substantially at a center of the rear surface. The spring support 115 has a cylindrical shape with a central axis extending along the front-rear direction. A portion of the rear surface of the left upper portion 111 surrounding the spring support 115 is recessed forward.

The right lower portion 112 has, as a whole, a rectangular parallelepiped shape that is shorter in the left-right direction than in the front-rear direction and shorter in the up-down direction than in the left-right direction. A lower surface 112L of the right lower portion 112 forms a continuous uniform flat surface together with the lower flange portion 114F on the right side of the left upper portion 111. A stopper 116 having a small rectangular parallelepiped shape is disposed on the lower surface 112L of the right lower portion 112 to project downward therefrom. The stopper 116 is located near a rear end of the lower surface 112L of the right lower portion 112 and on the left side of the lower surface 112L of the right lower portion 112, or located adjacent to and to the right of the lower flange portion 114F on the right side of the left upper portion 111. Further, a length in the left-right direction of the lower surface 112L of the right lower portion 112 is sufficiently greater than a length in the left-right direction of the upper abutment surface 113S formed in the left upper portion 111. The lower surface 112L of the right lower portion 112 may be referred to as a main body facing surface.

Further, a lower projection 117 is disposed on the lower surface 112L of the right lower portion 112 to project downward relative to the surrounding surface. The lower projection 117 is disposed in the vicinity of a front end of the lower surface 112L. In the left-right direction, the lower projection 117 is located substantially at a center of the lower surface 112L and occupies approximately one-third to one-fourth of the lower surface 112L. Also, an inclined surface 118 is formed in the right lower portion 112, in the vicinity of a front end of the right lower portion 112. The inclined surface 118 has a shape obtained by obliquely cutting off the front lower part slightly leaving an upper part of the front surface of the right lower portion 112. The inclined surface 118 is a flat sloping surface that extends rearward and downward from a position on the front surface of the right lower portion 112 near the upper end of the front surface, passes through the lower surface 112L of the right lower portion 112, and continuously extends rearward and downward in the lower projection 117 to reach a lower surface of the lower projection 117.

In addition, a link plate 119 is disposed on the rear side of the lever 110 in such a manner as to be connected to both the left upper portion 111 and right lower portion 112. The link plate 119 is formed in a plate shape that is thin in the front-rear direction. Also, as viewed in the front-rear direction, the link plate 119 is formed in a right triangle shape having a hypotenuse and two legs. A portion of the link plate 119 corresponding to one of the two legs abuts a rear end portion of a right surface of the left upper portion 111, and the other of the two legs abuts a rear end portion of an upper surface of the right lower portion 112.

In manufacturing the insertion unit 88 (see FIG. 13), the insertion unit 88 is placed in a state in which the left upper portion 111 is inserted between the upper portion 102 and the lower portion 103 of the slide guide 100, the upper rail 105 is fitted in between the two upper flange portions 113F (i.e., fitted in the upper groove 113D), and the lower rail 106 is fitted in between the two lower flange portions 114F (i.e., fitted in the lower groove 114D). This places the insertion unit 88 in a state in which the lever 110 can be moved (or slid) in the front-rear direction relative to the slide guide 100.

In addition, in the insertion unit 88, the spring support 108 of the slide guide 100 is inserted in a rear end of the spring 120 and the spring support 115 of the lever 110 is inserted in a front end of the spring 120 while the spring 120 is compressed from its natural state. The insertion unit 88 is fixed to the stage 61 by a mounting screw 130 in a state in which a right side portion of the slide guide 100 abuts a portion of a left surface of the left plate 82 of the stage 61 in the vicinity of a front end of the left surface.

In the insertion unit 88 thus assembled, the upper rail 105 is inserted in the upper groove 113D, and the lower rail 106 is inserted in the lower groove 114D. Thus, while the lever 110 is restricted from moving relative to the slide guide 100 in the up-down direction and left-right direction, it is allowed to move relative to the slide guide 100 in the front-rear direction. However, when the stopper 116 (see FIGS. 17A and 17B) abuts the stopper 107 (see FIGS. 15A and 15B) of the slide guide 100, the lever 110 is restricted from moving forward. Also, when a rear end portion of the lever 110 abuts the left plate 82 of the stage 61, the lever 110 is restricted from moving rearward.

Further, in the insertion unit 88, the lever 110 is urged forward relative to the slide guide 100 by the elastic force of the spring 120. Thus, in the insertion unit 88, when no external force is applied to the lever 110, the lever 110 is in its frontmost position as illustrated in FIG. 13, and when a rearward external force is applied to the lever 110, the lever 110 is moved rearward, and when the external force is removed, the lever 110 is moved to the frontmost position.

Hereinafter, for convenience of description, the frontmost position to which the lever 110 can move forward will be referred to as the inserted position, and the rearmost position to which the lever 110 can move rearward will be referred to as the retreat position. The rearward direction, which is a direction in which the toner cartridge 65 moves when attached to the stage 61, may be referred to as an attaching direction, and the forward direction, which is a direction in which the toner cartridge 65 moves when detached from the stage 61, may be referred to as a detaching direction. The front-rear direction, which collectively refers to the forward direction and rearward direction, may be referred to as an attaching/detaching direction.

<3-3. Configuration of Toner Conveying Portion>

The toner conveying portion 62 (see FIG. 11) is located below the stage 61 and to the right of the developing drum units 31 (31C, 31M, and 31Y) for the three colors. For each of the three colors, the toner conveying portion 62 incudes a conveying path (not illustrated) that connects between a portion directly below the through-hole 81H of the stage 61 (see FIG. 13) and a right portion of the developing drum unit 31. In each of the three conveying paths, there is installed a conveying mechanism that conveys toner, which is powder, from the through-hole 81H side to the developing drum unit 31. For example, the conveying mechanism includes a spiral blade (not illustrated) having a central shaft extending along the conveying path, and when a driving force is supplied to the conveying mechanism from the driving unit 15 (see FIG. 2), the conveying mechanism rotates the blade in the conveying path to convey toner along the conveying path.

In view of simplification of the configuration or the like, the toner conveying portion 62 has no shutters or the like at interfaces of the respective conveying paths with the respective through-holes 81H of the stage 61. Thus, if the conveying mechanisms were operated in a state in which the toner cartridge 65 is not attached to the stage 61, the toner conveying portion 62 might discharge toner in the conveying paths through the interfaces with the through-holes 81H toward the attachment space 80S of the stage 61.

Thus, the image forming apparatus 1 is configured to perform no printing operation and also perform no toner conveying operation in the toner conveying portion 62 when the toner cartridge 65 is not attached, by control by the controller 10 (see FIG. 2), which will be detailed later.

4. Attachment and Detachment of Toner Cartridge and Opening and Closing of Each Cover Next, attachment and detachment of the toner cartridge 65 to and from the stage 61 of the image forming unit 60 (see FIG. 11) of the image forming apparatus 1, and opening and closing of the main cover 6 and sub cover 7 of the cover 3 (see FIG. 1) will be described.

<4-1. Attachment and Detachment of Toner Cartridge to and from Stage>

Here, it will be assumed that the toner cartridge 65 is attached to the stage 61 in a state in which the image forming unit 60 (see FIG. 11) has been removed from the housing 50 of the image forming apparatus 1. As illustrated in FIG. 13, when the toner cartridge 65 is not installed in the attachment space 80S of the stage 61, the lever 110 of the insertion unit 88 is in the inserted position, which is the frontmost position. In this state, the toner cartridge 65 (see FIG. 12A) is positioned in front of the attachment space 80S of the stage 61, moved rearward, and gradually inserted into the attachment space 80S, by a user.

At this time, in the stage 61, the positioning projections 73P of the left plate 73 of the toner cartridge 65 are placed in the left guide groove 82D of the left plate 82, and the positioning projections 74P of the right plate 74 are placed in the right guide groove 83D of the right plate 83. Thereby, the stage 61 places the toner cartridge 65 in a state in which the left plate 73 and right plate 74 of the toner cartridge 65 are respectively extremely close to or in contact with the left plate 82 and right plate 83, and the lower plate 75 and shutter 76 of the toner cartridge 65 are extremely close to the lower plate 81, and restricts movement of the toner cartridge 65 in the left-right direction and up-down direction.

Figure 18:
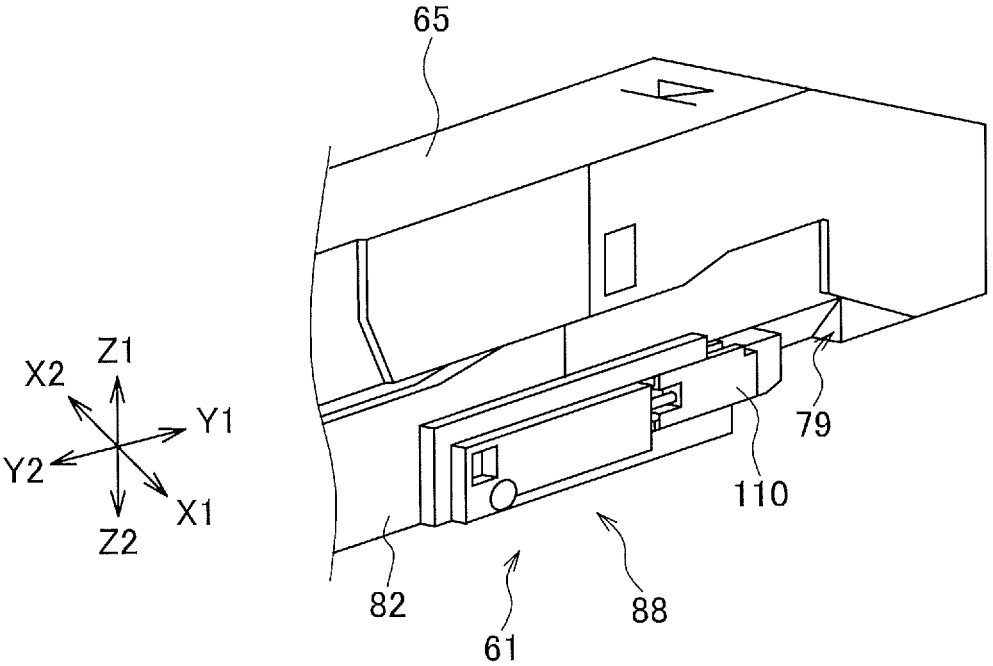
FIG. 18 is a schematic perspective view illustrating an aspect in which the toner cartridge is attached to the stage.
Figure 19A:
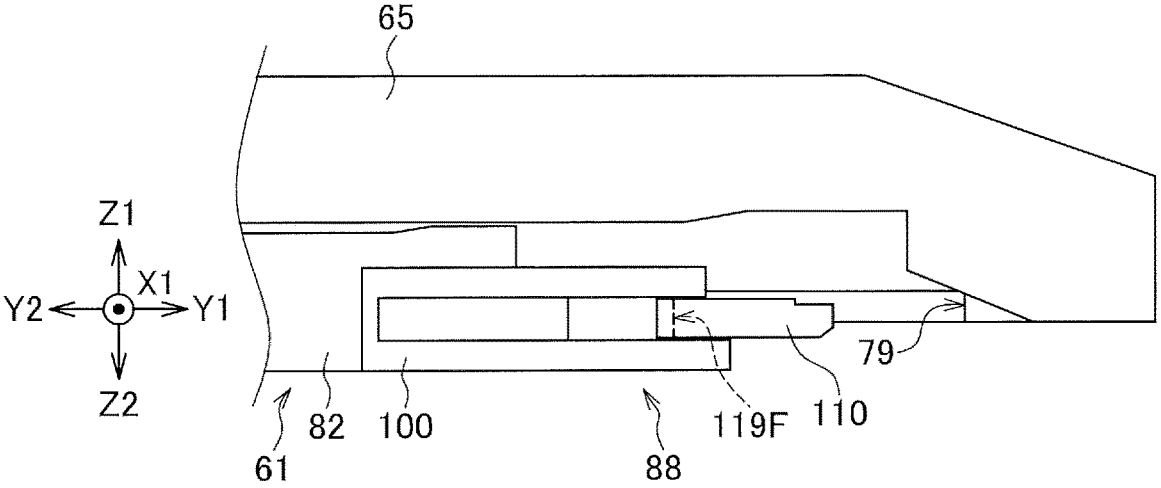
FIGS. 19A to 19C are schematic views illustrating an aspect in which the toner cartridge is attached to the stage.

At this time, in the insertion unit 88 of the stage 61, since no external force is applied to the lever 110, the lever 110 remains still in the inserted position, which is the frontmost position, as illustrated in FIG. 18, which is a perspective view, and FIG. 19A, which is a schematic left side view. At this time, the link rear surface 79 of the toner cartridge 65 is in front of the lever 110. In FIG. 19A, for convenience of description, the central portion 101 (see FIGS. 15A and 15B) of the slide guide 100 is omitted, and the profiles of the upper portion 102, lower portion 103, and lever 110 are depicted by solid lines. Also, in FIG. 19A, a link front surface 119F of the link plate 119 of the lever 110 is depicted by a dashed line.

In the stage 61, as the toner cartridge 65 is pushed rearward, the toner cartridge 65 gradually advances into the attachment space 80S with the rear plate 77 in front while the positioning projections 73P and 74P respectively move rearward in the left guide groove 82D and right guide groove 83D. Then, in the stage 61, a rear surface of the toner cartridge 65 comes into contact with a front surface of the rear portion 91 of the toner cartridge holder 85 (see FIG. 14) and the engagement claws 92C and 93C respectively enter and engage the holder engagement holes 73H and 74H.

Figure 19B:
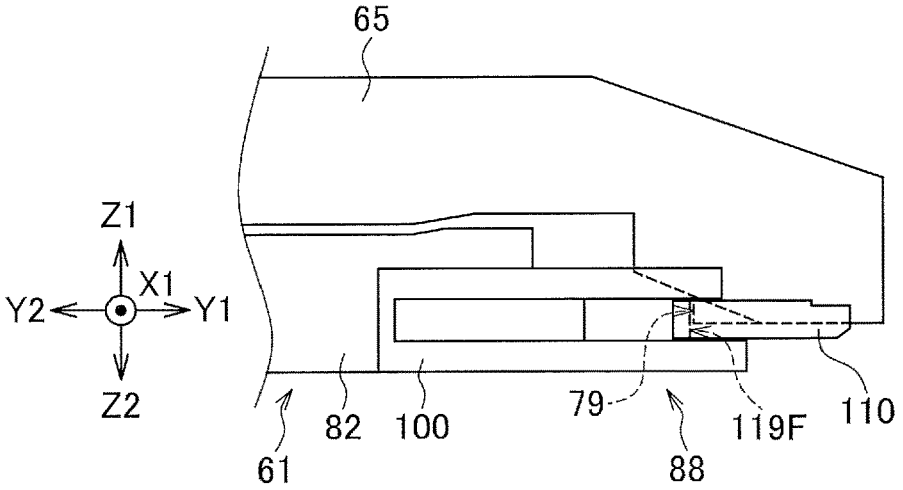

Substantially at the same time, in the insertion unit 88 of the stage 61, as illustrated in FIG. 19B, the link rear surface 79 (see FIG. 12B) of the toner cartridge 65 comes into contact with the link front surface 119F of the lever 110, and the toner cartridge 65 and lever 110 (or the link rear surface 79 and link front surface 119F) enter a state in which they can move together or in conjunction with each other. At this time, the front end of the lever 110 is located slightly behind a front end of the toner cartridge 65.

Thus, in the stage 61, when the toner cartridge 65 is further pushed rearward, the toner cartridge 65 moves rearward together with the toner cartridge holder 85 and lever 110 substantially as a unit while exerting rearward forces on the toner cartridge holder 85 and lever 110. Thus, the lever 110 moves rearward in conjunction with the toner cartridge 65, so that the lever 110 gradually moves from the inserted position, which is the frontmost position, toward the retreat position, which is the rearmost position.

At this time, the elastic force of the spring (not illustrated) installed in the urging mechanism 86 (see FIG. 13) is exerted on the toner cartridge holder 85. Specifically, when the toner cartridge holder 85 is within the front half of its movable range, the spring exerts a forward force on the toner cartridge holder 85 and thus slightly blocks the toner cartridge 65 from moving rearward, whereas when the toner cartridge holder 85 is within the rear half of its movable range, the spring exerts a rearward force on the toner cartridge holder 85 and thus supports the toner cartridge 65 in moving rearward.

Also, in the stage 61, at or around the time the toner cartridge 65 is held by the toner cartridge holder 85, the shutter 76 (see FIG. 12B) engages a predetermined portion (not illustrated) disposed in the lower plate 81. Thereby, the stage 61 allows the toner cartridge housing 70 to move rearward while holding the position of the shutter 76. Thus, the stage 61 moves the shutter 76 forward relative to the toner cartridge housing 70 and gradually opens the three toner supply openings 75H.

Figure 19C:
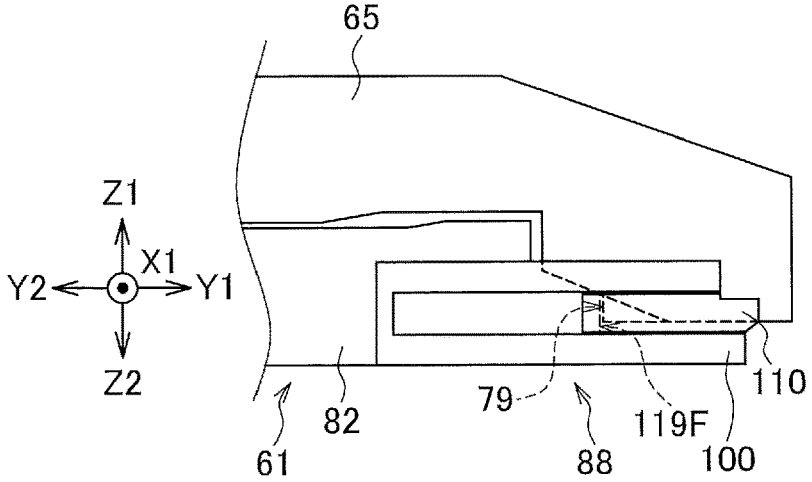

Then, in the stage 61, the toner cartridge 65 reaches its rearmost position in the attachment space 80S (see FIG. 11), entering a state in which the toner cartridge 65 is completely attached to the stage 61. At this time, in the insertion unit 88, the lever 110 reaches the retreat position, which is the rearmost position, as illustrated in FIG. 19C.

In the stage 61, when a forward force is applied to the toner cartridge 65 attached to the stage 61, the toner cartridge 65 moves forward, and finally reaches a position in front of the attachment space 80S, completely leaving the stage 61. At this time, in the stage 61, the toner cartridge holder 85, insertion unit 88, and shutter 76 operate in the order of FIGS. 19C, 19B, and 19A, or in the order and direction opposite to those at the time of the attachment.

The front-rear direction, which is a direction in which the toner cartridge 65 is moved when the toner cartridge 65 is attached to and detached from the stage 61, may be referred to as an attaching/detaching direction. Also, a direction in which the cover 3 is opened and closed may be referred to as an opening/closing direction, and a direction (or the left-right direction) across (or perpendicular to) both the opening/closing direction and attaching/detaching direction may be referred to as a width direction.

<4-2. Attachment and Detachment of Toner Cartridge and Opening and Closing of Each Cover>

Next, the relationship between attachment and detachment of the toner cartridge to and from the stage 61 of the image forming apparatus 1 and opening and closing of each of the covers, i.e., the main cover 6 and sub cover 7, of the cover 3 will be described.

First, it will be assumed that the image forming unit (see FIG. 11) with the toner cartridge 65 attached to the stage 61 is installed in the main body 2 of the image forming apparatus 1, as illustrated in FIG. 1. In this case, the lever 110 of the insertion unit 88 is in the retreat position, which is the rearmost position, as illustrated in FIG. 11, which is a perspective view, and FIG. 19C, which is a schematic left side view.

Figure 20:
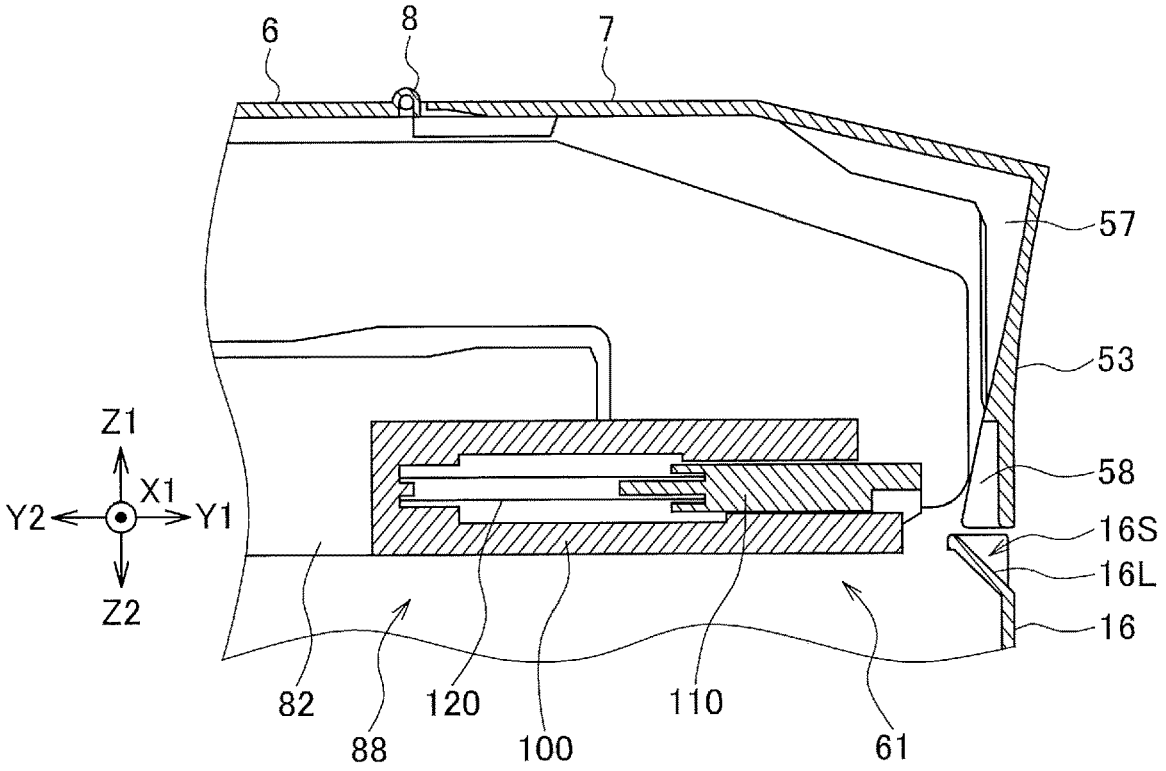
FIG. 20 is a schematic sectional view illustrating an aspect in which the sub cover is closed while the lever is in a retreat position.

At this time, in the image forming apparatus 1, as illustrated in FIG. 20, which is a schematic sectional view, the front end of the toner cartridge 65 is located behind the front surface of the front panel 16 of the main body 2, and the front end of the lever 110 is located behind the front end of the toner cartridge 65. In this case, the sub cover 7 is in the sub closed state, in which it is completely closed without interfering with the toner cartridge 65 and the like, as illustrated also in FIGS. 1, 10A, and 10B.

In the insertion unit 88, when the toner cartridge 65 is attached to the stage 61, the lever 110 is in the retreat position and thus does not interfere with the sub cover 7, allowing the sub cover 7 to be completely closed. At this time, the cartridge rib 57 of the sub cover 7 is in contact with or extremely close to the toner cartridge 65.

Here, it will be assumed that in the image forming apparatus 1, the sub cover 7 is opened (see FIGS. 6 to 8), and the toner cartridge 65 is pulled out forward and detached from the stage 61. At this time, in the cover 3, the sub cover switch 18 changes from the "on" state to the "off" state, as illustrated in FIGS. 9A and 9B. With this, the controller 10 (see FIG. 2) enters a state in which it does not cause the parts to operate.

Figure 21:
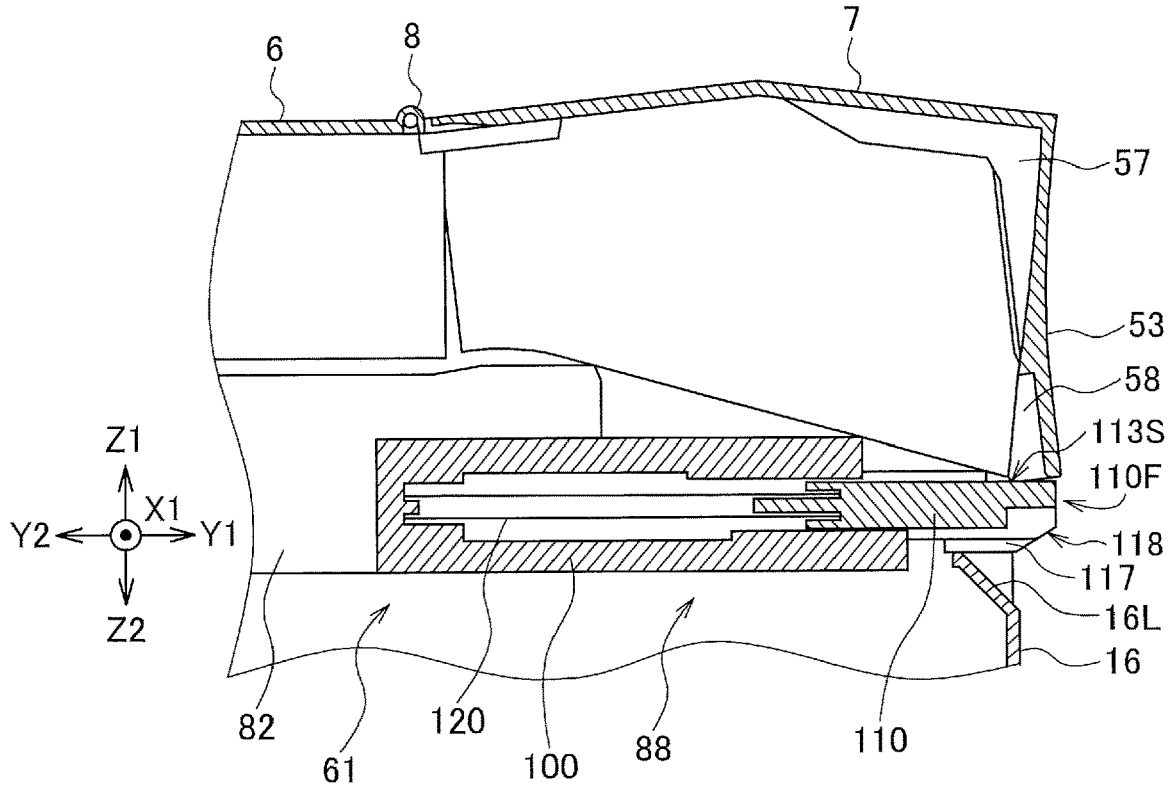
FIG. 21 is a schematic sectional view illustrating an aspect in which the sub cover is tried to be closed while the lever is in an inserted position.

At this time, in the insertion unit 88 of the stage 61, since no rearward external force is applied to the lever 110, the lever 110 is in the inserted position, which is in front of the retreat position, as illustrated in FIGS. 13, 7, etc. Thus, in the image forming apparatus 1, as illustrated in FIG. 21, which is a schematic sectional view, the lower surface of the lower projection 117 of the lever 110 is placed on an upper end of the front panel inclined portion 16L of the front panel 16 of the main body 2, and the front end of the lever 110 is projected forward relative to the front surface of the front panel 16.

Figure 22:
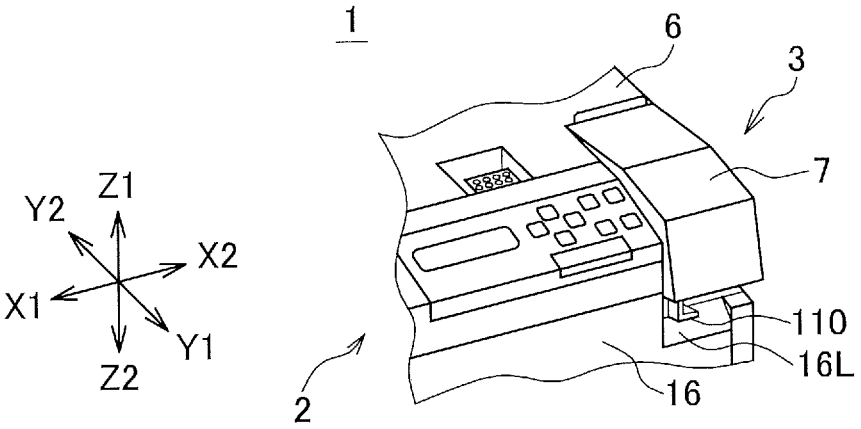
FIG. 22 is a schematic view illustrating an aspect in which the sub cover is tried to be closed while the lever is in the inserted position.
Figure 23:
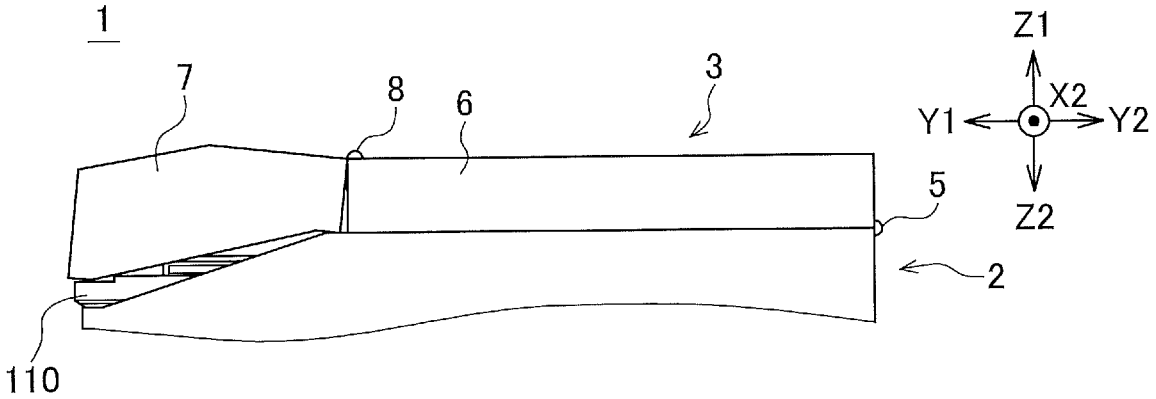
FIG. 23 is a schematic view illustrating an aspect in which the sub cover is tried to be closed while the lever is in the inserted position.

Thus, in the image forming apparatus 1, when the sub cover 7 in the open state is rotated by user's operation or the like, at the time the lower end of the front portion 53 or lower ends of the lever ribs 58 of the sub cover 7 come(s) into contact with the upper abutment surface 113S of the lever 110, the lever 110 restricts the rotation and prevents the sub cover 7 from changing to the closed state, as illustrated in FIG. 22, which is a perspective view, and FIG. 23, which is a right side view.

As such, in the image forming apparatus 1 with the toner cartridge 65 unattached thereto, since the lever 110 in the inserted position intervenes between the sub cover 7 and the front panel 16, the lever 110 prevents the sub cover 7 from being closed and keeps the sub cover 7 slightly open, as illustrated also in FIGS. 9A and 9B. Thus, the image forming apparatus 1 can maintain the sub cover switch 18 (see FIGS. 9A and 9B) in the off state. Thereby, the controller 10 maintains the stopped state without starting various operations.

The lever 110 may be referred to as an insertion member, and the lever front end portion 110F, which is a portion of the lever 110 that is inserted between the sub cover 7 and the front panel 16, may be referred to as an insertion portion. Further, the upper abutment surface 113S, which is a surface of the lever 110 that faces and abuts the sub cover 7 of the cover 3, may be referred to as a cover facing surface.

By the way, in the image forming apparatus 1, by opening only the sub cover 7 while keeping the main cover 6 closed, as illustrated in FIGS. 6 to 8, the toner cartridge 65 is allowed to be attached to and detached from the stage 61. In addition, in the image forming apparatus 1, even in a state in which the sub cover 7 is closed relative to the main cover 6, by opening the main cover 6 as illustrated in FIG. 4, the toner cartridge 65 is allowed to be attached to and detached from the stage 61.

Here, it will be assumed that, in the image forming apparatus 1, the entire cover 3 has been opened with the sub cover 7 in the sub closed state (i.e., with the sub cover 7 closed relative to the main cover 6), and the toner cartridge 65 has been detached from the stage 61, as illustrated in FIG. 4. In this case, in the insertion unit 88 of the stage 61, the lever 110 is in the inserted position, which is the frontmost position, as with the case illustrated in FIG. 21, etc.

Figure 24:
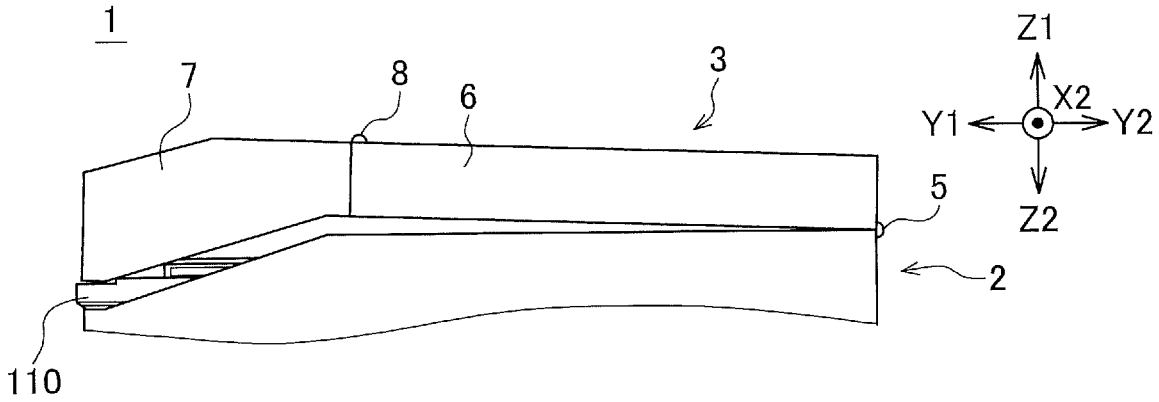
FIG. 24 is a schematic view illustrating an aspect in which a main cover is tried to be closed while the lever is in the inserted position.

It will be assumed that, in the image forming apparatus 1 in this state, a forward and downward force is applied to the main cover 6 of the cover 3 by user's operation, and the entire cover 3 is rotated toward the main body 2. At this time, the cover 3 gradually approaches the main body 2, and the lower end of the front portion 53 or the lower ends of the lever ribs 58 of the sub cover 7 come(s) into contact with the upper abutment surface 113S of the lever 110, as illustrated in FIG. 24, which is a left side view.

In this state, when a downward force is further applied to the main cover 6 of the cover 3, the lever 110 in the inserted position allows the main cover 6 to be closed, but prevents the sub cover 7 from being closed. Thus, in the cover 3, while the main cover 6 is closed, the engagement between the sub projection 55D and the main ridge portion 47 of the cover engagement unit 59 is released (see FIGS. 9A and 9B and FIGS. 10A and 10B), the sub cover 7 is rotated about the sub cover rotation portion 8 and changes from the sub closed state to the sub open state.

Thus, the sub cover 7 changes to the sub open state, as with the case illustrated in FIG. 23, and the image forming apparatus 1 can maintain the sub cover switch 18 in the off state, as illustrated in FIGS. 9A and 9B. Thereby, the controller 10 maintains the stopped state without starting various operations.

5. Advantages, Etc

In the present embodiment, in a case where the toner cartridge 65 (serving as a detachable part) is not attached to the main body 2, when the cover 3 is tried to be closed, the lever 110 (serving as an insertion member) in the inserted position is sandwiched between the main body 2 and the cover 3, preventing the cover 3 from being closed. Thus, from the existence of the lever 110 and the fact that the cover 3 cannot be closed, the user can immediately recognize that the toner cartridge 65 is not attached. Then, the user can immediately open the cover 3, attach the toner cartridge 65 to locate the lever 110 in the retreat position, and properly close the cover 3.

With the present embodiment, it is possible to provide an image forming apparatus capable of easily preventing an erroneous operation in attachment and detachment of a detachable part with a simple configuration, and a detachable part capable of easily preventing an erroneous operation in attachment and detachment to and from a main body with a simple configuration.

The image forming apparatus 1 (see FIG. 1) according to the present embodiment includes the insertion unit 88 provided to the stage 61 to and from which the toner cartridge 65 is attached and detached (see FIG. 13), and is configured so that the lever 110 moves to the retreat position on the rear side and the inserted position on the front side in accordance with attachment and detachment of the toner cartridge 65 (see FIGS. 19A, 19B, 19C, 20, and 21).

Also, the image forming apparatus 1 is configured so that the cover 3 rotates about the rotation portion 5 relative to the main body 2 (see FIG. 4), the cover 3 is constituted by the main cover 6 and sub cover 7, and the sub cover 7 rotates about the sub cover rotation portion 8 relative to the main cover 6 (see FIGS. 6 to 8).

With this configuration, in the image forming apparatus 1, when the sub cover 7 is opened to open the sub opening 50ES (see FIG. 6, etc.) and the toner cartridge 65 is detached, the lever 110 of the insertion unit 88 is located in the inserted position on the front side. Thus, in the image forming apparatus 1, when the sub cover 7 is rotated and tried to be closed with the toner cartridge 65 unattached, the lower end of the front portion 53 or the lower ends of the lever ribs 58 of the sub cover 7 come(s) into contact with the upper abutment surface 113S of the lever 110, preventing the sub cover 7 from changing to the closed state (see FIGS. 21 to 23). Thus, the lever front end portion 110F of the lever 110 is sandwiched between the sub cover 7 and the front panel 16.

Thereby, in the image forming apparatus 1, the sub cover switch 18 is maintained in the off state (see FIGS. 9A and 9B). With this, the controller 10 maintains a standby state without starting printing operation. Thus, in the image forming apparatus 1, it is possible to reliably avoid a situation in which toner in the conveying paths is discharged through the interfaces with the through-holes 81H to the attachment space 80S of the stage 61 and contaminates the attachment space 80S and which can occur when the toner conveying portion 62 (see FIG. 11) starts to operate even though the toner cartridge 65 is not attached.

In other words, by means of the lever 110 of the insertion unit 88, the image forming apparatus 1 can easily and reliably avoid a situation in which when the toner cartridge 65 is not attached, a user closes the sub cover 7 and erroneously causes the toner conveying portion 62 to start to operate due to, for example, carelessness.

Also, in the image forming apparatus 1, when the toner cartridge 65 is not attached to the stage 61, the lever 110 is located in the inserted position on the front side, and when a user tries to close the sub cover 7, the sub cover 7 is raised from the main cover 6 and a tip of the lever 110 is visually perceivable from the outside (see FIGS. 20 to 22). Thus, the user can intuitively and quickly understand, from the state of the sub cover 7 and the existence of the lever 110, that it is not possible to close the sub cover 7 and it is required to reopen the sub cover 7, attach the toner cartridge 65, and then close the sub cover 7.

In particular, in the inserted position, the tip of the lever 110 is located in front of the front surface of the front panel 16 of the main body 2 (see FIGS. 7 and 21 to 23). Thus, in the image forming apparatus 1, the lever 110 in the inserted position can not only mechanically prevent the sub cover 7 from being closed but also visually inform that the sub cover 7 cannot be closed. Thus, in the image forming apparatus 1, even in a state in which it is difficult to visually determine from the outside whether the toner cartridge 65 is present or absent, because of the existence of the sub cover 7, as illustrated in FIGS. 22 and 23, the user can see the tip of the lever 110 and thereby easily understand that the toner cartridge 65 is not attached.

Also, in the image forming apparatus 1, the lever 110 of the insertion unit 88 is located relatively near the display 13 for displaying information to the user and the operation unit 14 (see FIG. 1, etc.) for receiving operations from the user. Specifically, in the image forming apparatus 1, the lever 110 is disposed above the front panel 16 of the main body 2 together with the display 13 and operation unit 14. Also, in the image forming apparatus 1, the lever 110 is disposed in the sub opening 50ES (see FIG. 6, etc.), on the side of the sub opening 50ES near the display 13 and operation unit 14. Thus, the image forming apparatus 1 can allow the user, who tends to often look at the display 13 and operation unit 14, to easily perceive the existence of the lever 110 located near them.

By the way, for example, it is conceivable that an image forming apparatus is provided with a sensor for detecting the presence or absence of a toner cartridge, and configured so that when a controller determines, based on a detection result of the sensor, that the toner cartridge is not attached, a predetermined error message is displayed on a display. However, in this case, prior to the above processing, the image forming apparatus needs to perform initialization and start processing of the controller and other processing after power-on. Thus, it takes a relatively long time before the display of the error message. Also, in this case, for example, when a user performs a power-on operation and sees information displayed on the display after closing a cover, the user has probably already taken the hands off the cover. Thus, the user is forced to reach for the cover and open it again, which is bothersome.

On the other hand, the image forming apparatus 1 according to the present embodiment can allow a user to extremely quickly find that the toner cartridge 65 is not attached and thus needs to be attached, merely by looking at the state of the sub cover 7, the tip of the lever 110, or the like, without waiting for a long time, and immediately take the necessary action. Also, in the image forming apparatus 1, while a user is holding the sub cover 7 with a hand and rotating the sub cover 7 toward the closed state, when the sub cover 7 comes into contact with the lever 110, the user can find that the toner cartridge 65 is not attached. At this time, in the image forming apparatus 1, the user can immediately change the direction of the force applied to the sub cover 7 by the hand, and quickly and smoothly perform a series of actions: opening the sub cover 7, attaching the toner cartridge 65, and closing the sub cover 7.

Also, the insertion unit 88 is configured so that the lever 110 slides in the front-rear direction relative to the slide guide 100. In accordance with this, the stage 61 is configured so that when the toner cartridge 65 is attached, the lever 110 engages the toner cartridge 65 moving rearward and moves rearward to the retreat position, and when the toner cartridge 65 is detached, the lever 110 moves forward to the inserted position together with the toner cartridge 65 due to the elastic force of the spring 120 (see FIG. 13).

Thus, in the image forming apparatus 1, it is not necessary to provide, between the lever 110 and the toner cartridge 65, a space for preventing interference between the lever 110 and the toner cartridge 65, and it is possible to allow the lever 110 to smoothly move, merely by ensuring an extremely small space other than the space for the toner cartridge 65. In particular, in the image forming apparatus 1, as illustrated in FIGS. 9A, 9B, 10A, and 10B, in both the retreat position and inserted position, the area of the lever 110 as viewed in the front-rear direction is extremely small. Thus, providing the lever 110 does not substantially increase the size of the entire apparatus.

Also, in the insertion unit 88, on both the upper and lower sides of the lever 110, the upper rail 105 and lower rail 106 of the slide guide 100 are placed in the upper groove 113D and lower groove 114D, respectively (see FIGS. 9A and 9B). Thus, in the insertion unit 88, on both the upper and lower sides of the lever 110, the position of the lever 110 relative to the slide guide 100 in the left-right direction can be restricted.

Thus, in the insertion unit 88, when a downward force is applied to the upper abutment surface 113S of the lever 110 by the lever ribs 58 or the like of the sub cover 7, it is possible to prevent the lever 110 from distorting, or the upper abutment surface 113S from tilting to the right or left. Thus, in the insertion unit 88, it is possible to reliably prevent the lever 110, slide guide 100, or the like from being damaged and the sub cover 7 from being closed to change the sub cover switch 18 (see FIGS. 9A and 9B, etc.) to the on state, due to distortion, tilting, or the like of the lever 110.

From another viewpoint, in the image forming apparatus 1, when the lever 110 is in the inserted position, it is necessary to reliably prevent the sub cover 7 from being closed to turn the sub cover switch 18 "on". Thus, in the lever 110, the length from the upper abutment surface 113S to the lower surface of the lower projection 117 needs to be sufficiently large. On the other hand, in the image forming apparatus 1, as illustrated in FIGS. 9A, 9B, 10A, and 10B, there is insufficient space around the toner cartridge 65, and the length of the lever 110 in the left-right direction needs to be relatively small in order to avoid interference with the toner cartridge 65, front panel 16, main cover 6, or the like.

Thus, in the lever 110, the length of the left upper portion 111 in the left-right direction is less than the length of the left upper portion 111 in the up-down direction (see FIGS. 16A, 16B, 17A, and 17B). However, if the lever 110 consisted only of the left upper portion 111, the lever 110 might have insufficient strength against external force applied to the lever 110 via the sub cover 7 and be deformed, distorted, or damaged. Thus, through focusing on a space under the toner cartridge 65, the right lower portion 112 is provided to the lever 110 and connected to the left upper portion 111 with the link plate 119. Thereby, in the image forming apparatus 1, it is possible to effectively increase the strength (or stiffness) of the lever 110 while avoiding interference between the lever 110 and the toner cartridge 65.

Further, in the insertion unit 88, as illustrated in FIGS. 10A and 10B, the right lower portion 112 of the lever 110 is located to the left of the space in which the shutter 76 of the toner cartridge 65 moves during the attachment and detachment. Thereby, in the image forming apparatus 1, when the toner cartridge 65 is attached to and detached from the stage 61, it is possible to prevent the shutter 76 from coming into contact with the lever 110. Thus, in the image forming apparatus 1, when the toner cartridge 65 is attached and detached, it is possible to avoid a situation in which an unwanted force is exerted on the shutter 76 to slide the shutter 76 and open the toner supply openings 75H (see FIGS. 12A and 12B) to scatter toner to the outside.

Further, in the insertion unit 88, the upper flange portions 113F are formed on a part of the upper surface 113 (see FIGS. 16A, 16B, 17A, and 17B) of the lever 110 outside the front approximately one-fourth of the upper surface 113, and the upper abutment surface 113S is formed in front of the upper flange portions 113F. Thus, in the image forming apparatus 1, it is possible to avoid a situation in which the lever ribs 58 or the like of the sub cover 7 come into contact with the upper flange portions 113F to apply a great force to them, wear or plastically deform them, and make the lever 110 incapable of smoothly sliding and which could occur if the upper flange portions 113F were formed to extend to near the front end of the lever 110.

Also, in the insertion unit 88, as illustrated in FIGS. 15A, 15B, 17A, and 17B, the distance L12 of the lever 110 is greater than the distance L1 of the slide guide 100 and less than the distance L2 of the slide guide 100. Also, in the insertion unit 88, the distance L11 of the lever 110 is less than the distance L1 of the slide guide 100. Thereby, in the insertion unit 88, when the lever 110 is in the inserted position, the lever 110 is intentionally allowed to be slightly displaced in the up-down direction relative to the slide guide 100, and play is provided between the lever 110 and the slide guide 100. This allows the front end of the lever 110 to swing in the up-down direction.

In particular, in the insertion unit 88, as illustrated in FIGS. 15A and 15B, the front end of the upper portion 102 of the slide guide 100 is located behind the front end of the lower portion 103, and the upper portion 102 is shorter than the lower portion 103 as viewed from the rear portion 104. Thereby, in the insertion unit 88, it is possible to increase a swing width by which the lever front end portion 110F can swing upward when the lever 110 is in the inserted position on the front side, compared to a case where the upper portion 102 is equal in length to the lower portion 103.

In addition to this, in the insertion unit 88, the lever 110 is provided with the inclined surface 118 that is inclined to extend downward as it extends rearward (see FIGS. 17A and 17B), on the lower side of the lever 110 in the vicinity of the front end of the lever 110. Thus, in the image forming apparatus 1, when the lever 110 moves from the retreat position on the rear side to the inserted position on the front side, even if the lower surface of the lower projection 117 of the lever 110 is located below the upper end of the front panel inclined portion 16L of the front panel 16, the lever 110 can climb on the upper end while sliding the inclined surface 118 of the lever 110 on the upper end.

In particular, in the image forming apparatus 1 (see FIG. 4), from the viewpoint of, for example, improving efficiencies of replacement of consumables and various maintenance operations, the image forming unit 60 is configured to be attachable to and detachable from the housing 50 of the main body 2. Thus, in the image forming apparatus 1, the height (or the position in the up-down direction) of the insertion unit 88 relative to the front panel 16 may be displaced from the designed value, due to a displacement of the attachment position of the image forming unit 60 relative to the housing 50, manufacturing errors of parts, or the like. In this respect, in the image forming apparatus 1, by virtue of the play provided to the lever 110 and the inclined surface 118 formed in the lever 110, even when there is/are a displacement of the attachment position of the image forming unit 60 relative to the housing 50, manufacturing errors, or the like, the lever 110 can reliably climb on the upper end of the front panel inclined portion 16L when moving forward from the retreat position.

From another viewpoint, in the image forming apparatus 1, the insertion unit 88 is provided to the stage 61, which is a part of the image forming unit 60, which is attachable to and detachable from the housing 50 in the main body 2 (see FIG. 11). Thus, in the image forming apparatus 1, although the position accuracy of the lever 110 relative to the front panel 16 is low as compared to a case where the insertion unit 88 is directly mounted to the housing 50, the insertion unit 88 is replaced when the image forming unit 60, which is a consumable, is replaced. Thus, in the insertion unit 88, the lifetime of the lever 110 need not be equal to the lifetime of the image forming apparatus 1, and it is sufficient that the lever 110 have a lifetime such that the lever 110 functions properly until the image forming unit 60, including the lever 110, is replaced. Also, in the image forming apparatus 1, even when the lever 110 or slide guide 100 of the insertion unit 88 is damaged, it is sufficient to replace the image forming unit 60 with a new one. Thus, compared to a case of performing operations, such as repair or part replacement, on the housing 50 side, it is possible to reduce the effort and time required for the maintenance operation, and increase availability.

Further, if the insertion unit 88 were provided to the housing 50, it would become necessary to move the lever 110 to the inserted position when the image forming unit 60 is detached from the housing 50, and move the lever 110 to the retreat position when the image forming unit 60 with the toner cartridge 65 attached thereto is attached to the housing 50. In this case, it would become necessary to make the insertion unit 88 have a more complicated configuration.

In this respect, in the image forming apparatus 1 according to the present embodiment, since the insertion unit 88 is provided to the stage 61 to which the toner cartridge 65 is directly attached, it is possible to locate the lever 110 in the inserted position only when necessary, merely by moving the lever 110 in accordance with attachment and detachment of the toner cartridge 65 to and from the stage 61. Also, in the image forming apparatus 1, the position accuracy of the toner cartridge 65 relative to the stage 61 is significantly higher than the position accuracy of the toner cartridge 65 relative to the housing 50. Thus, in the image forming apparatus 1, when the toner cartridge 65 is attached to and detached from the stage 61, it is possible to move the lever 110 of the insertion unit 88 with extremely high accuracy, compared to a case where the insertion unit 88 is provided to the housing 50 side.

Also, the cover 3 is configured so that, when the sub cover 7 is in the sub closed state (see FIGS. 10A and 10B), the sub closed state is maintained by engagement between the main ridge portion 47 and the sub projection 55D of the cover engagement unit 59. On the other hand, the cover 3 is configured so that, when an upward and rearward external force is applied to the front portion 53 or the like of the sub cover 7, the sub projection 55D climbs over the main ridge portion 47, releasing the engagement of the cover engagement unit 59 and changing the sub cover 7 to the sub open state (see FIGS. 9A and 9B, etc.).

Thus, in the image forming apparatus 1, when the entire cover 3 is opened with the sub cover 7 in the sub closed state, and the main cover 6 is tried to be closed with the toner cartridge 65 unattached (see FIG. 4), the sub cover 7 comes into contact with the lever 110 in the inserted position (see FIG. 24). At this time, in the image forming apparatus 1, when a downward force is applied to the main cover 6 by the user, the sub cover 7 prevented by the lever 110 from moving downward releases the engagement of the cover engagement unit 59 and changes to the sub open state, and the main cover 6 is closed (see FIG. 23).

Thus, in both the state in which only the sub cover 7 is open and the state in which the entire cover 3 is open, when the toner cartridge 65 is not attached, since the image forming apparatus 1 locates the lever 110 in the inserted position, the image forming apparatus 1 can reliably prevent the sub cover 7 from being closed, regardless of whether the main cover 6 is open or closed.

Further, in the image forming apparatus 1, the sub cover 7 is provided with the lever ribs 58 (see FIG. 5, etc.), and when the sub cover 7 is tried to be closed while the toner cartridge 65 is not attached to the stage 61 and the lever 110 is in the inserted position (see FIGS. 9A and 9B), the front end of the lever 110 is located behind the front portion 53 of the sub cover 7.

Also, in the image forming apparatus 1, even when the cover 3 is opened while the sub cover 7 is closed relative to the main cover 6 and in the sub closed state, and then the cover 3 is closed (see FIG. 24) while the toner cartridge 65 is not attached (see FIG. 4), the front end of the lever 110 is located behind the front portion 53 of the sub cover 7.

Thereby, in the image forming apparatus 1, regardless of opening and closing of the main cover 6, when the sub cover 7 comes into contact with the upper abutment surface 113S of the lever 110 in the inserted position, it is possible to make the lower ends of the lever ribs 58 provided behind the front portion 53 come into contact with the upper abutment surface 113S, instead of the front portion 53 of the sub cover 7. Thereby, in the image forming apparatus 1, it is possible to prevent scratches, deformations, or the like from occurring in the front portion 53, which is visible from the outside.

By the way, in the image forming apparatus 1, while the insertion unit 88 is mounted to the left plate 82 of the stage 61 in this embodiment, it may be provided to the right plate 83. However, the shape of each of the slide guide 100 and lever 110 of the insertion unit 88 is laterally inverted. In this case, in the image forming apparatus 1, in a direction along the rotation axis of the sub cover rotation portion 8, i.e., in the left-right direction, the position of the lever 110 is located on a side of a center of the sub cover 7 or a center of the toner cartridge 65 opposite the positions of the cover engagement unit 59 and sub cover switch 18.

On the other hand, since the sub cover 7 can elastically deform to some extent as described above, when external forces in different directions are applied to the right and left sides of the sub cover 7, the sub cover 7 is distorted, and a lower edge of the front portion 53 may be greatly tilted relative to the rotation axis of the sub cover rotation portion 8. Thus, in the configuration in which the insertion unit 88 is mounted to the right plate 83 of the stage 61, for example, it is possible that while the lever 110 is sandwiched between a portion of the front portion 53 near a right end thereof and the front panel 16, a portion of the front portion 53 near a left end thereof abuts the front panel 16, and the sub cover switch 18 is turned "on".

Thus, in the image forming apparatus 1 according to the present embodiment, the insertion unit 88 is mounted to the left plate 82, so that in the left-right direction, the position of the lever 110 is located on the same side of the center of the sub cover 7 or the center of the toner cartridge 65 as the positions of the cover engagement unit 59 and sub cover switch 18. Thereby, in the image forming apparatus 1, even if the sub cover 7 is distorted, when the lever 110 is in the inserted position and the lever ribs 58 or the like of the sub cover 7 abut the lever 110, it is possible to maintain the cover engagement unit 59 in the disengaged state, and reliably keep the sub cover switch 18 "off".

With the above configuration, when the toner cartridge 65 is detached from the stage 61, the image forming apparatus 1 according to the present embodiment moves the lever 110 of the insertion unit 88 provided to the stage 61 from the retreat position on the rear side to the inserted position on the front side and causes the front end of the lever 110 to project forward relative to the front surface of the front panel 16. Thus, when the sub cover 7 is tried to be closed while the toner cartridge 65 is not attached, the lever 110 is sandwiched between the sub cover 7 and the front panel 16, and thereby the image forming apparatus 1 can prevent the sub cover 7 from being closed. Thereby, the image forming apparatus 1 can prevent a situation in which, while the toner cartridge 65 is not attached, the sub cover switch 18 is turned "on" and the toner conveying portion 62 starts to operate, discharging toner to the interior of the apparatus and contaminating it.

6. Other Embodiments

In the above embodiment, the lever 110 is moved to the inserted position and retreat position by moving the lever 110 relative to the slide guide 100 of the insertion unit 88 in the front-rear direction, i.e., in a direction that is the same as the direction in which the toner cartridge 65 is moved when it is attached and detached. However, this is not mandatory. For example, the lever 110 may be moved in a direction, such as the up-down direction or left-right direction, differing from the direction in which the toner cartridge 65 is moved when it is attached and detached. Also, the path along which the lever 110 moves is not limited to be linear, and may have various shapes, such as curved line shapes, polygonal line shapes, or arc shapes. Further, the attitude of the lever 110 in the retreat position need not be the same as that in the inserted position, and may be different. It is sufficient that when the toner cartridge 65 is detached from the stage 61, the lever 110 can be moved to the inserted position, and when the toner cartridge 65 is attached to the stage 61, the lever 110 can be move to a position in which the lever 110 does not prevent the sub cover 7 from being closed.

Also, in the above embodiment, the lever 110 is formed by connecting the left upper portion 111 and right lower portion 112 with the link plate 119 (see FIGS. 16A, 16B, 17A, and 17B). However, this is not mandatory. For example, the right lower portion 112 may be omitted, and the lever 110 may be constituted by the left upper portion 111 and link plate 119.

Further, in the above embodiment, the lever front end portion 110F, which is sandwiched by the sub cover 7 and front panel 16, is provided on the front side of the lever 110, and the link plate 119 for moving the lever 100 in conjunction with attachment and detachment of the toner cartridge 65 is provided on the rear side of the lever 110 (see FIGS. 16A, 16B, 17A, 17B, etc.). However, this is not mandatory. For example, it is also possible that a portion of the lever 110 including the lever front end portion 110F and a portion of the lever 110 including the link plate 119 are separate parts, and the separate parts are linked to each other via a predetermined link mechanism or the like. It is sufficient that at least the lever front end portion 110F of the lever 110 can be moved to the inserted position and retreat position in conjunction with movement of the toner cartridge 65 in the attaching/detaching direction.

Further, in the above embodiment, in the stage 61, the right lower portion 112 of the lever 110 is disposed to the left of the position in which the shutter 76 moves when the toner cartridge 65 is attached and detached (see FIGS. 10A and 10B). However, this is not mandatory. For example, the right lower portion 112 of the lever 110 may be disposed below or under the position in which the shutter 76 moves when the toner cartridge 65 is attached and detached.

Further, in the above embodiment, the upper rail 105 and lower rail 106 are provided on the slide guide 100 of the insertion unit 88, and the upper groove 113D and lower groove 114D are provided in the lever 110. However, this is not mandatory. For example, it is also possible that grooves are provided in the slide guide 100 and rails are provided on the lever 110. Also, it is not mandatory that rails and grooves be provided on both the upper and lower sides of the lever 110, and for example, it is also possible that a rail and a groove is provided on only one of the upper and lower sides of the lever 110. It is sufficient that the lever 110 can be moved in the front-rear direction relative to the slide guide 100, and the lever 110 can be restricted from moving in the left-right direction and up-down direction, or directions across (or perpendicular to) the attaching/detaching direction. However, it is preferable to provide play such that the front end of the lever 110 can swing in the up-down direction when the lever 110 is in the inserted position.

Further, in the above embodiment, in the slide guide 100 (see FIGS. 15A and 15B), the front end of the upper portion 102 is located behind the front end of the lower portion 103. However, this is not mandatory. For example, the front end of the upper portion 102 may be located in front of the front end of the lower portion 103, or the front end of the upper portion 102 may be located directly above the front end of the lower portion 103.

Further, in the above embodiment, the inclined surface 118 is formed in the lower side of lever 110 in the vicinity of the front end of the lever 110 (see FIGS. 17A, 17B, 21, etc.). However, this is not mandatory. For example, in a case where an inclined surface that extends downward as it extends rearward from its upper end is provided behind the front panel inclined portion 16L of the front panel 16 of the main body 2, or other cases, the inclined surface 118 may be omitted from the lever 110.

Further, in the above embodiment, play is provided between the slide guide 100 and the lever 110 of the insertion unit 88 so that the front end of the lever 110 can swing in the up-down direction when the lever 110 is in the inserted position. However, this is not mandatory. For example, in a case where the position accuracy of the stage 61 relative to the housing 50 of the main body 2 is high, or other cases, the play may be omitted.

Further, in the above embodiment, the cover 3 is constituted by two covers, the main cover 6 and sub cover 7, and the lever 110 of the insertion unit 88 is located so that it can prevent closing of the sub cover 7 relating to attachment and detachment of the toner cartridge 65. However, this is not mandatory. For example, the cover 3 may be undivided and of a single piece, or may be divided into three or more. In these cases, the inserted position of the lever 110 of the insertion unit 88 may be set so that the lever 110 in the inserted position can prevent closing of a cover that needs to be opened when the toner cartridge 65 is attached and detached.

Further, in the above embodiment, the sub opening 50ES (see FIG. 6, etc.) is opened and closed by rotating the sub cover 7 about the sub cover rotation portion 8 relative to the main cover 6. However, this is not mandatory. For example, the sub opening 50ES (see FIG. 6, etc.) may be opened and closed by sliding the sub cover 7 relative to the main cover 6 or swinging the sub cover 7 via a predetermined link mechanism. In these cases, the lever 110 in the inserted position may prevent closing of the sub cover 7 when the toner cartridge 65 is not attached.

Further, in the above embodiment, when the toner cartridge 65 is attached to the stage 61, the shutter 76 is moved forward to open the toner supply openings 75H, and when the toner cartridge 65 is detached from the stage 61, the shutter 76 is moved rearward to close the toner supply openings 75H. However, this is not mandatory. For example, without linking attachment and detachment of the toner cartridge 65 to opening and closing of the shutter 76, the toner supply openings 75H may be opened and closed by the shutter 76 being moved by a user operating a predetermined lever.

Further, in the above embodiment, the image forming unit 60 (see FIG. 11) having the stage 61 is attachable to and detachable from the housing 50 (see FIG. 4) of the main body 2. However, this is not mandatory. For example, the stage 61 may be separated from the developing drum units 31 for the respective colors and mounted to the housing 50.

Further, in the above embodiment, the toner cartridge 65 contains toners of three colors. However, this is not mandatory. For example, the toner cartridge 65 may contain toner(s) of an arbitrary number of colors, such as four colors or one color.

Further, in the above embodiment, the toner cartridge 65 containing toner is taken as a detachable part that is attached to and detached from the main body 2 of the image forming apparatus 1. However, this is not mandatory. For example, various parts, such as photosensitive drums, that are attached to and detached from the image forming apparatus 1 after a predetermined cover is opened can be taken as the detachable part.

Further, in the above embodiment, the present invention is applied to the image forming apparatus 1, which is a single-function printer. However, this is not mandatory. For example, the present invention is applicable to image forming apparatuses having other various functions, such as a multi-function peripheral (MFP) having a copier function and a facsimile function.

Further, the present invention is not limited to the above embodiments. Specifically, the scope of the present invention covers embodiments obtained by arbitrarily combining some or all of the above embodiments and embodiments obtained by extracting part of the above embodiments.

Further, in the above embodiment, the image forming apparatus 1 as an image forming apparatus is constituted by the main body 2 as a main body, the cover 3 as a cover, and a lever 110 as an insertion member. However, this is not mandatory. The image forming apparatus may be constituted by a main body, a cover, and an insertion member that have other various configurations.

The present invention is applicable to, for example, an image forming apparatus including a main body and a cover that is openable and closable relative to the main body, wherein a toner cartridge is attached to and detached from the main body while the cover is open.

What is claimed is:

1. An image forming apparatus comprising:

a main body to which a detachable part is attachable, the main body having an opening;

a cover that opens and closes the opening of the main body; and an insertion member that, when the detachable part is not attached to the main body, is in an inserted position where the insertion member is inserted between the main body and the cover and prevents closing of the cover, and when the detachable part is attached to the main body, is in a retreat position where the insertion member is not inserted between the main body and the cover and allows closing of the cover, wherein the insertion member includes a main body side surface and a cover side surface, the cover includes a first abutment portion that comes into contact with the cover side surface of the insertion member, the main body includes a second abutment portion that faces the first abutment portion of the cover when the opening is closed by the cover, and when the detachable part is not attached to the main body, the insertion member is sandwiched between the main body and the cover in such a manner that the main body side surface of the insertion member abuts on the second abutment portion of the main body.

2. The image forming apparatus of claim 1, wherein the main body further includes:

an image forming unit that forms a developer image on an image carrier with developer; and a housing that houses the image forming unit, the detachable part contains the developer, and the image forming unit includes a stage to and from which the detachable part is attached and detached.

3. The image forming apparatus of claim 2, wherein the insertion member is provided to the stage.

4. The image forming apparatus of claim 3, wherein the detachable part includes:

a supply opening for supplying the developer to the image forming unit; and a shutter that opens the supply opening when the detachable part is attached to the image forming unit, and closes the supply opening when the detachable part is detached from the image forming unit, and the insertion member is not located between the shutter and the stage when the detachable part is attached to and detached from the stage.

5. The image forming apparatus of claim 2, wherein the image forming unit is attachable to and detachable from the housing when the opening is open.

6. An image forming apparatus comprising:

a main body to which a detachable part is attachable, the main body having an opening;

a cover that opens and closes the opening of the main body; and an insertion member that, when the detachable part is not attached to the main body, is in an inserted position where the insertion member is inserted between the main body and the cover and prevents closing of the cover, and when the detachable part is attached to the main body, is in a retreat position where the insertion member is not inserted between the main body and the cover and allows closing of the cover, wherein the detachable part is attached to and detached from the main body by being slid in predetermined attaching and detaching directions relative to the main body, and the insertion member moves to the inserted position and the retreat position by being slid substantially parallel to the attaching and detaching directions relative to the main body.

7. The image forming apparatus of claim 6, wherein the detachable part is attached to the main body by being slid in the attaching direction relative to the main body, and detached from the main body by being slid in the detaching direction opposite the attaching direction, and the insertion member is placed in the inserted position by being slid in the detaching direction relative to the main body, and placed in the retreat position by being slid in the attaching direction.

8. The image forming apparatus of claim 6, further comprising a slide guide that allows movement of the insertion member in the attaching and detaching directions relative to the main body between the inserted position and the retreat position, and restricts movement of the insertion member in a direction across the attaching and detaching directions.

9. The image forming apparatus of claim 8, wherein the insertion member has an insertion portion that is inserted between the main body and the cover, and when the insertion member is in the inserted position, the slide guide holds the insertion member in such a manner as to allow the insertion portion to swing in a direction toward the main body or a direction toward the cover.

10. The image forming apparatus of claim 9, wherein the insertion member has a main body facing surface that faces the main body when the insertion member is in the inserted position and a cover facing surface that faces the cover when the insertion member is in the inserted position, the main body facing surface having an end in the detaching direction, and a portion of the main body facing surface near the end is inclined to approach the cover facing surface toward the end.

11. The image forming apparatus of claim 6, wherein the cover moves in opening and closing directions when opened and closed, the insertion member has a main body facing surface that faces the main body when the insertion member is in the inserted position and a cover facing surface that faces the cover when the insertion member is in the inserted position, and in a width direction across the opening and closing directions and the attaching and detaching directions, a length of the main body facing surface is greater than a length of the cover facing surface.

12. An image forming apparatus comprising:

a main body to which a detachable part is attachable, the main body having an opening;

a cover that opens and closes the opening of the main body; and an insertion member that, when the detachable part is not attached to the main body, is in an inserted position where the insertion member is inserted between the main body and the cover and prevents closing of the cover, and when the detachable part is attached to the main body, is in a retreat position where the insertion member is not inserted between the main body and the cover and allows closing of the cover, wherein the opening includes a main opening and a sub opening;

the cover includes:

a main cover that opens and closes the main opening, the main cover closing the main opening without closing the sub opening; and a sub cover that opens and closes the sub opening, and when the detachable part is not attached to the main body, the insertion member is inserted between the main body and the sub cover.

13. The image forming apparatus of claim 12, wherein the main cover is mounted to the main body via a main opening/closing portion, and the sub cover is mounted to the main cover via a sub opening/closing portion.

14. The image forming apparatus of claim 13, wherein the main opening/closing portion allows the main cover to rotate relative to the main body, and the sub opening/closing portion allows the sub cover to rotate relative to the main cover.

15. The image forming apparatus of claim 14, wherein the main opening/closing portion allows the main cover to rotate about a rotation axis, and the sub opening/closing portion allows the sub cover to rotate about a rotation axis parallel to the rotation axis of the main cover.

16. The image forming apparatus of claim 13, further comprising a cover engagement unit that engages the sub cover with the main cover when the sub opening is closed by the sub cover.

17. The image forming apparatus of claim 16, wherein in a state in which the main opening is opened by the main cover, the sub cover is engaged with the main cover by the cover engagement unit, and the detachable part is not attached to the main body, when the main opening is closed by the main cover, the engagement of the sub cover with the main cover is released by the insertion member.

18. The image forming apparatus of claim 17, wherein the sub opening/closing portion allows the sub cover to rotate relative to the main cover about a rotation axis, and in a direction along the rotation axis of the sub opening/closing portion, the cover engagement unit is provided on the same side of a center of the sub cover as the insertion member in the inserted position.

* * * * *